US007507453B2

(12) United States Patent
Geddes et al.

(10) Patent No.: US 7,507,453 B2
(45) Date of Patent: Mar. 24, 2009

(54) DIGITAL DECORATION AND MARKING OF GLASS AND CERAMIC SUBSTRATES

(75) Inventors: Pamela A. Geddes, Alden, NY (US); Daniel J. Harrison, Pittsford, NY (US); Jim Ibarra, Williamsville, NY (US); Claire A Jalbert, Buffalo, NY (US); Joel D. Neri, Youngstown, NY (US); Michael J. Draper, Medina, NY (US)

(73) Assignee: International Imaging Materials, Inc, Amherst, NY (US)

( * ) Notice: Subject to any disclaimer, the term of this patent is extended or adjusted under 35 U.S.C. 154(b) by 377 days.

(21) Appl. No.: 11/406,616

(22) Filed: Apr. 19, 2006

(65) Prior Publication Data

US 2006/0191427 A1 Aug. 31, 2006

Related U.S. Application Data

(63) Continuation-in-part of application No. 11/071,015, filed on Mar. 3, 2005, and a continuation-in-part of application No. 11/072,028, filed on Mar. 4, 2005, now Pat. No. 7,374,801, and a continuation-in-part of application No. 11/074,155, filed on Mar. 7, 2005, now Pat. No. 7,438,973, which is a continuation of application No. 10/621,976, filed on Jul. 17, 2003, now Pat. No. 6,990,904, which is a continuation-in-part of application No. 10/265,013, filed on Oct. 4, 2002, now Pat. No. 6,766,734, which is a continuation-in-part of application No. 10/080,783, filed on Feb. 22, 2002, now Pat. No. 6,722,271, which is a continuation-in-part of application No. 09/961,493, filed on Sep. 22, 2001, now Pat. No. 6,629,792, which is a continuation-in-part of application No. 09/702,415, filed on Oct. 31, 2000, now Pat. No. 6,481,353.

(60) Provisional application No. 60/702,067, filed on Jul. 22, 2005.

(51) Int. Cl.
*B41M 5/40* (2006.01)

(52) U.S. Cl. ..... 428/32.79; 156/235; 428/32.51

(58) Field of Classification Search ..... None
See application file for complete search history.

(56) References Cited

U.S. PATENT DOCUMENTS

| | | | |
|---|---|---|---|
| 3,489,587 | A | 1/1970 | Weingrad |
| 3,549,446 | A | 12/1970 | Bennett |
| 3,554,834 | A | 1/1971 | Bennett |
| 3,658,611 | A | 4/1972 | Gray |
| 3,772,049 | A | 11/1973 | Blanco |
| 3,860,471 | A | 1/1975 | Blanco |
| 3,870,536 | A | 3/1975 | Blanco |
| 3,894,167 | A | 7/1975 | Kluge |
| 3,898,362 | A | 8/1975 | Blanco |
| 3,933,552 | A | 1/1976 | Shumaker |

(Continued)

*Primary Examiner*—Bruce H Hess

(57) ABSTRACT

Disclosed in this specification is a decal assembly comprising a decal support, a releasable covercoat, a heat activatable layer, and an ink layer. The ink layer forms a digital image. The heat activatable layer has a high adhesion to a ceramic substrate at high temperatures and a low adhesion to the substrate at lower temperatures. Thus the adhesive properties of the decal are activated by heat. The resulting image has excellent adhesion to the substrate and resists the effects of washing.

24 Claims, 18 Drawing Sheets

U.S. PATENT DOCUMENTS 3,956,558 A 5/1976 Blanco
4,068,033 A 1/1978 Meade
4,275,222 A 6/1981 Scala, Jr.
4,292,104 A 9/1981 Heimbach
4,322,467 A 3/1982 Heimbach
4,322,545 A 3/1982 Scala, Jr.
4,475,980 A 10/1984 Rhemer
4,497,851 A 2/1985 de Vroom
4,536,218 A 8/1985 Ganho
4,537,862 A 8/1985 Francel
4,554,258 A 11/1985 Francel
4,574,063 A 3/1986 Scherer
4,624,731 A 11/1986 Ash
4,873,078 A 10/1989 Edmundson
4,892,847 A 1/1990 Reinherz
4,970,178 A 11/1990 Klimas
5,006,582 A 4/1991 Mancinelli
5,069,954 A * 12/1991 Cole et al. ..... 428/202
5,164,441 A 11/1992 Yang
5,192,612 A 3/1993 Otter
5,252,521 A 10/1993 Roberts
5,252,662 A 10/1993 Su
5,310,803 A 5/1994 Hansen
5,326,591 A 7/1994 Roberts
5,389,129 A 2/1995 Jordan
5,500,209 A 3/1996 Mendolia
5,512,124 A 4/1996 Hansen
5,536,627 A 7/1996 Wang
5,569,347 A 10/1996 Obata
5,631,057 A 5/1997 Sundet
5,643,636 A 7/1997 Usui
5,658,975 A 8/1997 Ulman
5,665,462 A 9/1997 Dewar
5,665,472 A 9/1997 Tanaka
5,712,021 A 1/1998 Hernandez
5,753,571 A 5/1998 Donohue
5,776,280 A 7/1998 Puckett
5,827,790 A 10/1998 Evans
5,883,193 A 3/1999 Karim
5,891,476 A 4/1999 Reo
5,985,076 A 11/1999 Misuda
6,008,157 A 12/1999 Takeuchi
6,013,409 A 1/2000 Chou
6,024,950 A 2/2000 Takada
6,031,021 A 2/2000 Kenny
6,031,556 A 2/2000 Tutt
6,036,809 A 3/2000 Kelly
6,045,646 A 4/2000 Yoshikawa
6,051,097 A 4/2000 Higuchi
6,051,171 A 4/2000 Takeuchi
6,060,214 A 5/2000 Ehrhart
6,083,610 A 7/2000 Hirose
6,086,700 A 7/2000 Valentini
6,113,725 A 9/2000 Kronzer
6,114,088 A 9/2000 Wolk
6,117,572 A 9/2000 Tidrow
6,121,356 A 9/2000 Lundberg
6,124,239 A 9/2000 Chapman
6,127,316 A 10/2000 Chapman
6,143,117 A 11/2000 Kelly
6,183,588 B1 2/2001 Kelly
6,462,096 B1 10/2002 Dino
6,481,353 B1 11/2002 Geddes
6,504,559 B1 1/2003 Newton
6,629,792 B1 10/2003 Geddes
6,717,686 B1 4/2004 Farros
6,722,271 B1 4/2004 Geddes
6,753,379 B1 6/2004 Kawate
6,766,734 B2 7/2004 Geddes
6,818,093 B1 11/2004 Taal
6,846,874 B2 1/2005 Baumert
6,849,581 B1 2/2005 Thompson
6,858,667 B1 2/2005 Flerlage
6,860,961 B2 3/2005 Gibes
6,870,011 B2 3/2005 MacQueen
6,884,840 B2 4/2005 Gleichenhagen
2004/0046788 A1 3/2004 Keane

* cited by examiner

DIGITAL DECORATION AND MARKING OF GLASS AND CERAMIC SUBSTRATES

CROSS-REFERENCE TO RELATED PATENT APPLICATIONS

This application claims the benefit of the filing date of U.S. provisional patent application 60/702,067 (filed on Jul. 22, 2005). This application is also a continuation-in-part of patent application U.S. Ser. No. 11/071,015 (filed Mar. 3, 2005); Ser. No. 11/072,028 (filed Mar. 4, 2005) now U.S. Pat. No. 7,374,801; Ser. No. 11/074,155 (filed Mar. 7, 2005) now U.S. Pat. No. 7,438,973; each of which are continuation applications of U.S. Ser. No. 10/621,976 (filed on Jul. 17, 2003) now U.S. Pat. No. 6,990,904; which is a continuation-in-part of U.S. Ser. No. 10/265,013 (filed on Oct. 4, 2002); now U.S. Pat. No. 6,766,734 (issued Jul. 27, 2004); which in turn is a continuation-in-part of U.S. Ser. No. 10/080,783 (filed on Feb. 22, 2002); now U.S. Pat. No. 6,722,271 (issued on Apr. 20, 2004); which in turn is a continuation-in-part of U.S. Ser. No. 09/961,493 (filed on Sep. 22, 2001), now U.S. Pat. No. 6,629,792 (issued Oct. 7, 2003); which in turn is a continuation-in-part of U.S. Ser. No. 09/702,415 (filed on Oct. 31, 2000); now U.S. Pat. No. 6,481,353 (issued on Nov. 19, 2002). The entire disclosure of each of these patents and patent applications is hereby incorporated by reference into this specification.

FIELD OF THE INVENTION

This invention pertains, in one embodiment, to a ceramic decal for transferring a digital image. The ceramic decal provides surface adhesion bonding between the digital image and a ceramic substrate. In one embodiment, the ceramic decal is a heat activatable ceramic decal.

BACKGROUND OF THE INVENTION

Fabricators of ceramic products often wish to transfer images onto such substrates. For example, glass manufacturers may wish to transfer a particular image into a glass substrate. Methods such as silk screening have been developed to transfer non-digital images onto such substrates, but the silk screen inherently limits the types of images that can be transferred. A particular screen must be made for each image, thus altering the image is difficult and costly to the fabricator. One solution to such a problem is the use of decals to transfer digital images to ceramic substrates.

Such decals are known to those skilled in the art. Reference may be had to U.S. Pat. No. 3,489,587 to Weingrad (Ceramic Decalcomanias); U.S. Pat. Nos. 3,549,446 and 3,554,834 both to Bennett (Decal Applying); U.S. Pat. No. 3,658,611 to Gray (Process for Decorating a Glass Surface); U.S. Pat. Nos. 3,772,049; 3,860,471; 3,870,536; 3,898,362; and 3,956,558 all to Blanco (Ceramic Decalcomania and the like); U.S. Pat. No. 3,894,167 to Kluge (Decalcomania for decorating ceramic ware); U.S. Pat. No. 4,068,033 to Meade (Heat-releasable decalcomanias and adhesive composition therefore); U.S. Pat. Nos. 4,292,104 and 4,322,467 both to Heimbach (Decalcomania manufacture and Decalcomania); U.S. Pat. No. 5,712,021 to Hernandez (Decals for all occasions); U.S. Pat. Nos. 6,036,809; 6,143,117; and 6,183,588 all to Kelly (Process for releasing a thin-film structure from a substrate, Process for transferring a thin-film structure to a temporary carrier; Process for transferring a thin-film structure to a substrate); U.S. Pat. No. 6,504,559 to Newton (Digital Thermal Printing Process); U.S. Pat. Nos. 6,504,559 and 6,722,271 both to Geddes (Ceramic Decal Assembly). The content of each of the aforementioned patents is hereby incorporated by reference into this specification.

The prior art fails to provide a digital decal which can be easily placed upon a ceramic substrate and selectively adhered to the substrate by heat activation.

It is an object of this invention to provide a heat activatable decal that transfers a digital image onto a ceramic substrate.

SUMMARY OF THE INVENTION

In accordance with the present invention, there is provided a decal assembly for transferring a digital image to a glass or ceramic substrate. The process of this invention is applicable to both ceramic substrates (such as, e.g., substrates comprised of glass, porcelain, ceramic whitewares, metal oxides, clays, porcelain enamel coated substrates and the like) and non-ceramic substrates (such as, e.g., substrates comprised of polymers, thermoplastics, elastomers, thermosets, organic coatings, films, composites, sheets and the like). In one preferred embodiment, the substrate used is a ceramic substrate.

As used herein, the term "ceramic" includes glass, conventional oxide ceramics, and non-oxide ceramics (such as carbides, nitrides, etc.). When the ceramic material is glass, and in one embodiment, such glass is preferably float glass made by the float process. See, e.g., pages 43 to 51 of "Commercial Glasses," published by The American Ceramic Society, Inc. (of Columbus Ohio) in 1984 as "Advances in Ceramics, Volume 18."

The ceramic substrate used in the process of this invention, in one embodiment, preferably is a material that is subjected to a temperature of at least about 550° C. during processing and, in one aspect of this embodiment, comprises one or more metal oxides. Typical of such preferred ceramic substrates are, e.g., glass, ceramic whitewares, enamels, porcelains, etc. Thus, by way of illustration and not limitation, one may use the process of this invention to transfer and fix color images onto ceramic substrates such as dinnerware, outdoor signage, glassware, imaged giftware, architectural tiles, architectural glass, window glass, color filter arrays, floor tiles, wall tiles, perfume bottles, wine bottles, beverage containers, and the like.

BRIEF DESCRIPTION OF THE DRAWINGS

The invention will be described by reference to the following drawings, in which like numerals refer to like elements, and in which.

Figure 1:
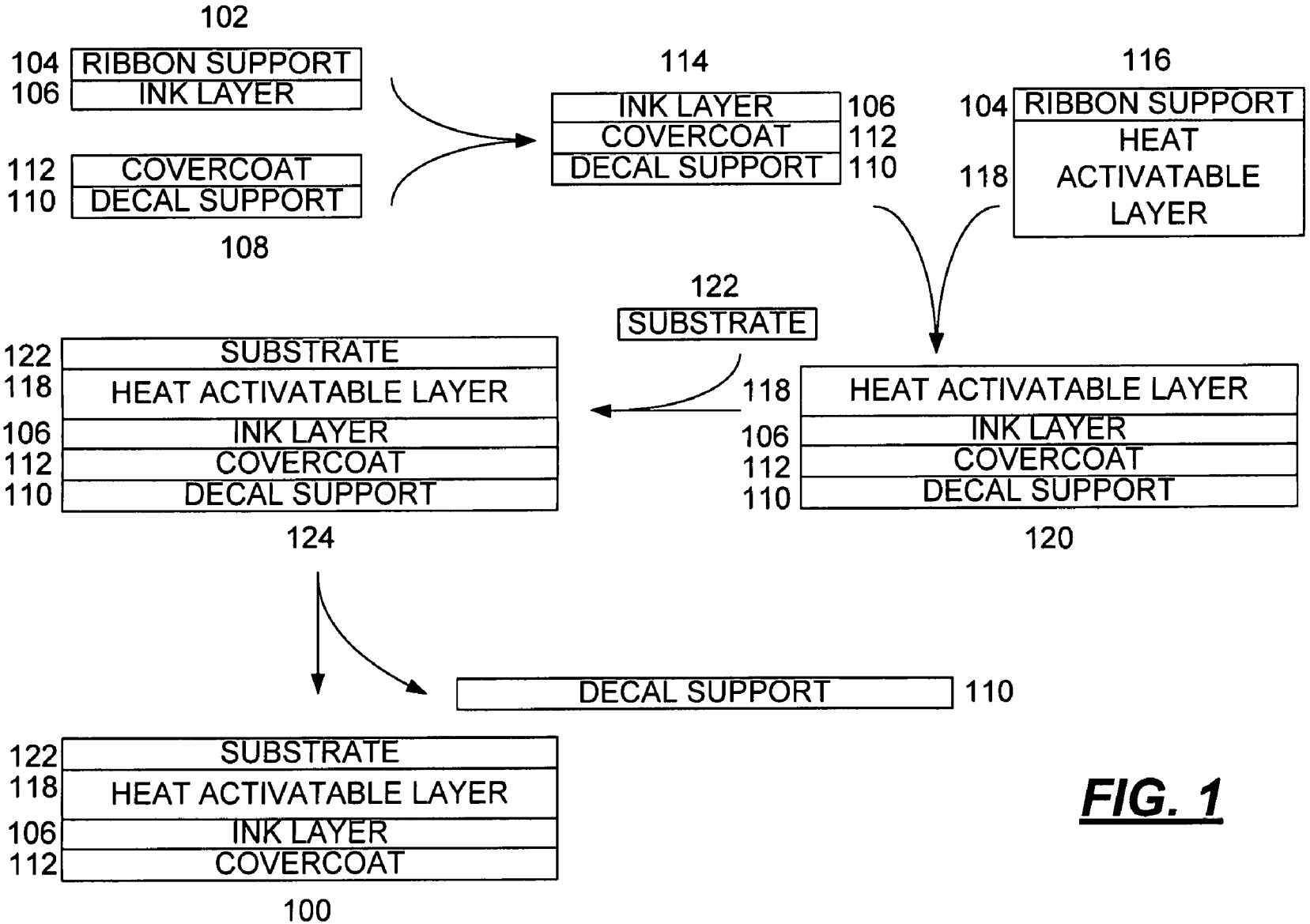
FIG. 1 is a flow diagram of a process for producing a ceramic decal.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

In accordance with one embodiment of this invention, there is provided a process for preparing a digitally imaged substrate. FIG. 1 illustrates the formation of imaged substrate 100. Thermal transfer ribbon 102 is comprised of ribbon support 104 and ink layer 106. Thermal transfer ribbon 102 may be printed with a digital printer (not shown) to produce a digital image. Covercoated transfer sheet 108 is comprised of decal support 110 and covercoat 112. The decal support 110 is a flexible substrate and may be comprised of a paper or film. If decal support 110 is a paper substrate, it may be comprised of a paper and a thermoplastic film. Paper based decal supports 110 may be first coated with a thermoplastic resin film to seal the surface of the paper substrate, rendering it impermeable to liquids. Such thermoplastic resin coatings are typically comprised of wax, polyethylene, polypropylene and the like. Such resin coatings facilitate the subsequent covercoating of the paper substrate with covercoat 112, preventing the liquid covercoat ink from being absorbed into the paper substrate before it has an opportunity to dry into a coated film on the surface of the substrate. Such a resin coating may also act as a covercoat release layer, facilitating the transfer of the imaged covercoat from the imaged decal support 120 to the substrate 122 to form an imaged substrate 100. Such resin coatings may also be applied to film based decal supports 110 to facilitate the transfer of the imaged covercoat the imaged decal support 120 to the substrate 122. Whether a paper or film support is used as the decal support 110, it is desirable that the covercoat 112 cleanly release from said support to ensure complete image transfer to substrate 122.

As further depicted in FIG. 1, thermal transfer ribbon 102 transfers a digital image onto covercoated transfer sheet 108, thus producing imaged, covercoated transfer sheet 114. In the embodiment depicted in FIG. 1, overcoat thermal transfer ribbon 116, which is comprised of ribbon support 104 and heat activatable layer 118, print heat activatable layer 118 onto imaged, covercoated transfer sheet 114, thus producing decal 120. In one embodiment, heat activatable layer 118 is printed over the entire surface of imaged, covered transfer sheet 114. In another embodiment, only a portion of such transfer sheet 114 is printed over with heat activatable layer 118. Decal 120 may be adhered to substrate 122, thus producing decal assembly 124. Decal support 110 is then peeled away from decal assembly 124, thus producing digitally imaged substrate 100.

Another embodiment of the present invention pertains to a thermal transfer assembly comprised of one or more thermal transfer ribbons 102 and a single covercoated transfer sheet 108. These thermal transfer assemblies are passed, one at a time, through a digital thermal transfer printing station in which ceramic material, such as a ceramic ink, is selectively transferred from thermal transfer ribbons 102 onto the covercoated transfer sheet 108 to prepare a decal comprised of a ceramic image. Such decals encompass the range of image types, colors, textures and opacities which are desirable for glass and ceramic imaging.

In a further embodiment of this invention the imaged substrate 100 is treated with heat to permanently affix the digital ceramic image to the substrate 122 to form a heat-treated imaged substrate. In another embodiment, decal assembly 124 is treated with heat with permanently affix the digital image to the substrate 122 prior to the removal of decal support 110.

Figure 2A:
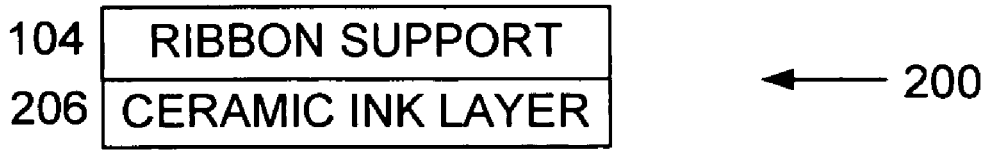
FIGS. 2A, 2B, 2C and 2D are cross-sectional diagrams of various thermal transfer ribbons.

Referring now to FIG. 2A, one thermal transfer ribbon 200 for use the present invention is illustrated. Thermal transfer ribbon 200 is similar to thermal transfer ribbon 102 of FIG. 1 except in that the ink layer 106 of ribbon 102 is a specifically a ceramic ink layer. Thus, thermal transfer ribbon 200 is comprised of ribbon support 104 and, disposed on support 104, a ceramic ink layer 206. The ceramic ink layer 206 is present at a coating weight of from about 2 to about 15 grams per square meter, and preferably comprises from about 15 to about 94.5 weight percent of a solid, carbonaceous binder, and at least one of a film-forming glass frit (clear, colored, or containing opacifiers or a means of opacifying during a subsequent melt and cooling step), an optional opacifying agent and an optional colorant (at a combined level for the film-forming glass frit, the opacifying agent and the colorant of at least 0.5 weight percent). The film-forming frit may be present in the ceramic ink layer 206 at a level from about 0 to about 75 weight percent; the opacifying agent may be present in the ceramic ink layer 206 at a level from about 0 to about 75 weight percent and preferably has a melting point at least 50° C. greater than that of the film-forming glass frit; and the colorant may be present in the ceramic ink layer 206 at a level from about 0 to about 75 weight percent. The thermal transfer ribbon 200 may be further comprised of heat activatable layer positioned between the ceramic ink layer and the ribbon support. Such an embodiment is illustrated in FIG. 2B.

Figure 2B:
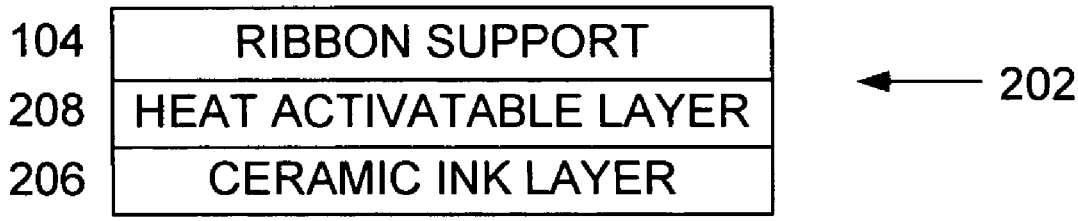

FIG. 2B illustrates thermal transfer ribbon 202. Thermal transfer ribbon 202 is comprised of ribbon support 104, heat activatable layer 208 contiguous with ribbon support 104, and ceramic ink layer 206. This heat activatable layer is preferably comprised of at least about 75 weight percent of a solid, carbonaceous binder and it preferably has a coating weight of from about 0.1 to about 5.0 grams per square meter.

The solid, carbonaceous binders used in the ceramic ink layer 206 and heat activatable layer 208 are comprised of one or more thermoplastic binder materials. One may use any of the thermal transfer binders known to those skilled in the art. Thus, e.g., one may use one or more of the thermal transfer binders disclosed in U.S. Pat. Nos. 6,127,316; 6,124,239; 6,114,088; 6,113,725; 6,083,610; 6,031,556; 6,031,021; 6,013,409; 6,008,157; 5,985,076; and the like. The entire disclosure of each of these United States patents is hereby incorporated by reference into this specification.

By way of further illustration, one may use a binder which preferably has a softening point from about 35 to about 150° C. and a multiplicity of polar moieties such as, e.g., carboxyl groups, hydroxyl groups, carboxylic acid groups, urethane groups, amide groups, amine groups, urea, epoxy resins, and the like. Some suitable binders within this class include polyester resins, bisphenol-A polyesters, copolymers made from terephthalic acid, polymethylmethacrylate, vinylchloride/vinylacetate resins, epoxy resins, nylon resins, urethane-formaldehyde resins, polyurethane, polyethylene-co-vinylacetate, mixtures thereof, and the like.

In one embodiment a mixture of two synthetic resins is used as the solid carbonaceous binder material. Thus, e.g., one may use a mixture comprising from about 40 to about 60 weight percent of polymethylmethacrylate and from about 40 to about 60 weight percent of vinylchloride/vinylacetate resin. In this embodiment, these materials collectively comprise the binder.

In one embodiment, the solid carbonaceous binder comprises polybutylmethacrylate and polymethylmethacrylate, comprising from 10 to 30 percent of polybutylmethacrylate and from 50 to 80 percent of the polymethylacrylate. In one embodiment, this binder comprises cellulose acetate propionate, ethylene-vinylacetate, vinylchloride/vinylacetate, polyurethanes, etc.

One may obtain these binders from many different commercial sources. Thus, e.g., some of them may be purchased from Dianal America Company of 9675 Bayport Blvd., Pasadena, Tex. 77507; suitable binders available from this source include "Dianal BR 113" and "Dianal BR 106." Similarly, suitable binders may also be obtained from the Eastman Chemicals Company (Tennessee Eastman Division, Box 511, Kingsport, Tenn.).

The solid carbonaceous binder may be further comprised of wax. The wax may be present from 0 to about 75 weight percent and, preferably, from about 5 to about 20 weight percent. In one embodiment, carbonaceous binder comprises from about 5 to about 10 weight percent of such wax. Suitable waxes which may be used include, e.g., carnuaba wax, rice wax, beeswax, candelilla wax, montan wax, paraffin wax, microcrystalline waxes, synthetic waxes such as oxidized wax, ester wax, polyethylene wax, Fischer-Tropsch wax, and the like. These and other waxes are well known to those skilled in the art and are described, e.g., in U.S. Pat. No. 5,776,280. One may also use ethoxylated high molecular weight alcohols, long chain high molecular weight linear alcohols, copolymers of alpha olefin and maleic anhydride, polyethylene, polypropylene, and the like. These and other suitable waxes are commercially available from, e.g., the Baker-Hughes Baker Petrolite Company of 12645 West Airport Blvd., Sugarland, Tex.

In one preferred embodiment, carnauba wax is used as the wax. As is known to those skilled in the art, carnauba wax is a hard, high-melting lustrous wax which is composed largely of ceryl palmitate; see, e.g., pages 151-152 of George S. Brady et al.'s "Material's Handbook," Thirteenth Edition (McGraw-Hill Inc., New York, N.Y., 1991). Reference also may be had, e.g., to U.S. Pat. Nos. 6,024,950; 5,891,476; 5,665,462; 5,569,347; 5,536,627; 5,389,129; 4,873,078; 4,536,218; 4,497,851; 4,4610,490; and the like. The entire disclosure of each of these United States Patents is hereby incorporated by reference into this specification.

The solid carbonaceous binder may also be comprised of from about 0 to 16 weight percent of plasticizers adapted to plasticize the resin used. Those skilled in the art are aware of which plasticizers are suitable for softening any particular resin. In one embodiment, there is used from about 1 to about 15 weight percent, by dry weight, of a plasticizing agent. Thus, by way of illustration and not limitation, one may use one or more of the plasticizers disclosed in U.S. Pat. No. 5,776,280 including, e.g., adipic acid esters, phthalic acid esters, chlorinated biphenyls, citrates, epoxides, glycerols, glycol, hydrocarbons, chlorinated hydrocarbons, phosphates, esters of phthalic acid such as, e.g., di-2-ethylhexylphthalate, phthalic acid esters, polyethylene glycols, esters of citric acid, epoxides, adipic acid esters, and the like.

In one embodiment, solid carbonaceous binder comprises from about 6 to about 12 weight percent of the plasticizer that, in one embodiment, is dioctyl phthalate. The use of this plasticizing agent is well known and is described, e.g., in U.S. Pat. Nos. 6,121,356; 6,117,572; 6,086,700; 6,060,214; 6,051,171; 6,051,097; 6,045,646, and the like. The entire disclosure of each of these United States Patent applications is hereby incorporated by reference into this specification. Other suitable plasticizers may be obtained from, e.g., the Eastman Chemical Company.

In one embodiment, the ceramic ink layer 206 is comprised of a ceramic ink composition that is coated onto a thin polymeric film to form the thermal imaging layer of a thermal transfer ribbon. In this embodiment the ceramic ink composition is first dissolved or dispersed in either an aqueous, solvent or hot melt vehicle. These liquid inks may then be applied in thin, uniform layers to the polymeric film with various coating methodologies such as gravure coating, slot die coating and the like. The coated layers may then be either dried, in the case or aqueous or solvent inks, or cooled in the case of hot melt inks to form a solid thermal transfer layer. When it is desirable to control the rheology of the liquid ink composition to minimize settling of the components or adjust the coat characteristics of the ink, rheology modifiers may be added to the system. The rheology of the liquid ink composition largely determines both the flow properties and the dispersion stability, particularly in cases where the dispersed material, e.g., the glass frits, opacifiers and colorants are denser than the vehicle and carbonaceous binders. Such materials have a gel like character in that they tend to act as high viscosity materials at low shear rates but flow easily upon being sheared are often desirable.

Such rheology modifying materials are used extensively in personal care (antiperspirants, lipsticks, shampoos, etc) and in oil field production (drilling fluids) and pipelines. Examples of rheology modifiers may be found in U.S. Pat. Nos. 5,500,209; 6,870,011; 6,849,581; 6,462,096; 4,574,063; 4,475,980; 4,322,545 and 4,275,222 all of which are incorporated into this specification by reference. Commercial examples of rheology modifiers are Uniclear 100 from Arizona Chemical Corporation of Jacksonville, Fla. and Disperbyk 2001 from BYK Cheme of Wallingford, Conn. In one preferred embodiment, the rheology modifier is an organic gellant. In yet a more preferred embodiment the rheology modifier is a polyamide. Other coating or dispersing aids (surfactants, dispersants, defoamers, antimicrobial agents, etc.) may also be included as needed.

Figure 2C:
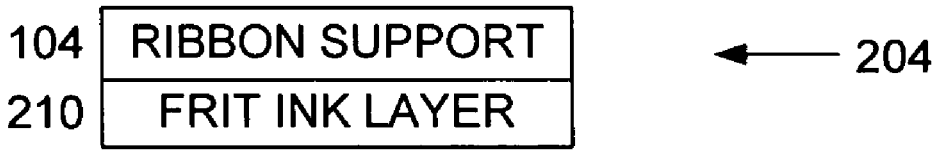

As shown in FIG. 2C, another thermal transfer ribbon, ribbon 204, is comprised of a ribbon support 104 and, disposed above support 104, a frit ink layer 210. Thermal transfer ribbon 204 is similar to thermal transfer ribbon 102 of FIG. 1 except in that the ink layer 210 of ribbon 204 is a specifically a frit ink layer. The frit ink layer 210 is present at a coating weight of from about 2 to about 15 grams per square meter, and preferably comprises from about 15 to about 94.5 weight percent of a solid carbonaceous binder and a film-forming glass frit. The film-forming frit may be present in the frit ink layer 210 at a level from about 0 to about 75 weight percent.

Figure 2D:
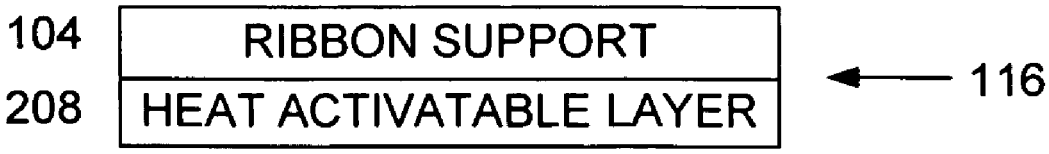
Figure 2E:
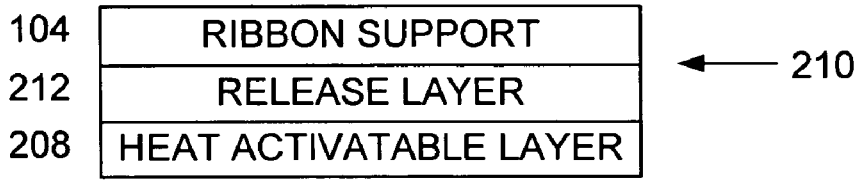
FIGS. 2E, 2F and 2G are cross-sectional diagrams of additional thermal transfer ribbons.

Referring now to FIG. 2D, another thermal transfer ribbon 116 is shown. Ribbon 116 is comprised of a ribbon support 104 and, disposed above support 104, a heat activatable layer 208. Ribbon 116 is configured to overcoat heat activatable layer 208 on a target covercoat. The heat activatable layer 208 is present at a coating weight of from about 0.3 to about 15 grams per square meter, and preferably comprises from about 15 to about 100 weight percent of a solid carbonaceous binder. The term "heat activatable," as used in this specification, means that the layer is only minimally tacky at room temperature, but develops tack when heated above room temperature. Such heat activatable layers 208 must be releasable from the thermal transfer ribbon 116 such that they can be printed onto a covercoated transfer sheet, such as covercoated transfer sheet 108 (see FIG. 1), in the process of creating a decal, such as decal 120 (see FIG. 1). In one embodiment this is facilitated by incorporating a release layer 212 between the ribbon support 104 of the thermal transfer ribbon 210 and the heat activatable layer 208. Reference may be had to FIG. 2E. The heat activatable layer 208 must adhere well to the covercoat 112 (see FIG. 1) as well as to ink layer 106 (i.e. any ceramic ink layer 206 or frit ink layers 210) printed on such covercoat 112. The heat activatable layer 208 is generally the last layer to be printed onto the covercoated transfer sheet 108 and thus represents the top surface of the ceramic decal 120. After printing, this heat activatable layer 208 should be low in tack such that it can be handled and positioned on various substrates 122. Hot melt adhesive, such as described in U.S. Pat. Nos. 5,310,803; 5,512,124; 6,818,093; 6,846,874; 6,860,961 and 6,858,667 may be used. It may be desirable to modify such adhesives to soften at a temperature conducive to the application method. Those skilled in the art could make such adjustments to the adhesive composition to optimize for the application and peel temperature. Some hot melt pressure sensitive adhesives such as those described in U.S. Pat. Nos. 5,006,582; 5,164,441; 5,252,662; 5,658,975 and 6,884,840 may also be used. It is preferred that these types of adhesives should be designed with low tack at room temperature. Heat activated or curable adhesives may also be used as described, for example, in U.S. Pat. Nos. 6,753,379; 5,883,193; and 5,192,612. Again, one skilled in the art could adjust the room temperature tack and the temperature of cure to provide the optimum performance in the application method. In general, thermoplastic, carbonaceous, organic polymers may be used. Such polymers should have melting, softening, or glass transition temperatures above room temperature as well as an ability to quickly adhere to substrates at the application temperatures.

Figure 2F:
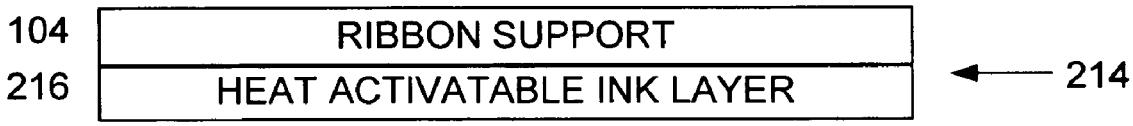
Figure 2G:
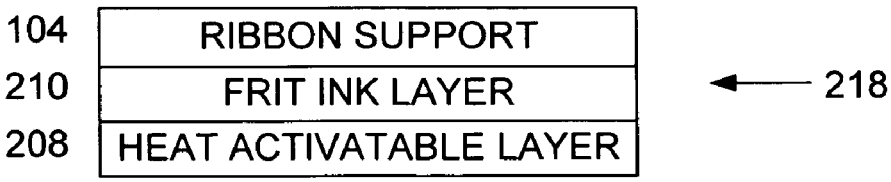

In one embodiment, illustrated in FIG. 2F, thermal transfer ribbon 214 may be constructed so as to combine two functions in that the binder portion of the frit layer may be chosen to incorporate both the properties needed for thermal transfer of a ceramic ink layer and the ability to act as a heat activatable layer during a process step that follows the printing of the decal. Thus layer 216 is a heat activatable ink layer. The heat activatable layer 208 may also be incorporated as a separate layer in the thermal transfer ribbon 218 (see FIG. 2F) containing the frit ink layer 210. It is preferable to have the heat activatable layer 208 as close to the ribbon support 104 as possible so that it is as close to the top of the printed decal 120 as possible, but it is not necessary that the heat activatable layer 208 be adjacent to the ribbon support 104.

The covercoated transfer sheet comprises a flat, flexible decal support 110 and a transferable covercoat 112 releasably bound to flat, flexible decal support 110. The transferable covercoat 112 is present at a coating weight of from about 2 to about 30 grams per square meter, and it comprises from about 15 to about 100 weight percent of a solid carbonaceous binder. When the transferable covercoat 110 is printed with an image from the thermal transfer ribbon 102 to form an imaged, covercoated transfer sheet 114, the image has a higher adhesion to the covercoat 112 than the covercoat 112 has to the flexible decal support 110, the imaged, covercoated transfer sheet (elements 105 and 112 of element 114) has an elongation to break of at least about 1 percent, and the imaged, covercoated transfer sheet 114 can be separated from decal support 110 with a peel force of less than about 30 grams per centimeter.

The covercoated transfer sheet 108 may be printed with one or more thermal transfer ribbons 102 to build up a complex image comprised of various ceramic inks, frit inks and heat activatable layers to form an imaged transfer decal, such as decal 120.

The imaged, covercoated transfer sheet 114 may be adhesively transferred from the decal 120 to a substrate 122. For transfer to occur, it is necessary to bring the imaged decal 120 into intimate contact with the substrate 122 such that adhesion between decal 120 and the substrate 122 may develop. Such adhesion may be facilitated by increasing the temperature of the decal 120, the substrate 122 or both. This may be done either before or after the decal 120 and substrate 122 are brought into contact. Adhesion between the decal 120 and substrate 122 may be further facilitated by exerting pressure on the decal 120 and substrate 122.

The adhesive transfer can be further facilitated through the use of adhesives or adhesive like substances. Adhesives may be applied to the substrate 122 or to the decal 120. Alternatively, adhesive like substances can be incorporated into the covercoat 112 or the frit ink layer 210 or the ceramic ink layer 206. The adhesive may be pressure activated, heat activated or pressure and heat activated. Heat activated adhesive-like substances may be added to the inks or covercoat 112 as a portion of the carbonaceous binders used in the layers and inks.

In one embodiment, illustrated in FIG. 1, a heat activatable layer 118 is printed on top of all other inks in the imaged decal 120 and used to facilitate transfer of the ink layer 106 in subsequent processes. The heat activatable layer 118 may be printed in an image wise fashion or as a flood coat over all of the imaged sections of the covercoated transfer decal 120.

Alternatively, the heat activatable layer 118 may be coated or laminated to the decal 120 or to the substrate 122 to which the image is intended to transfer.

Figure 3:
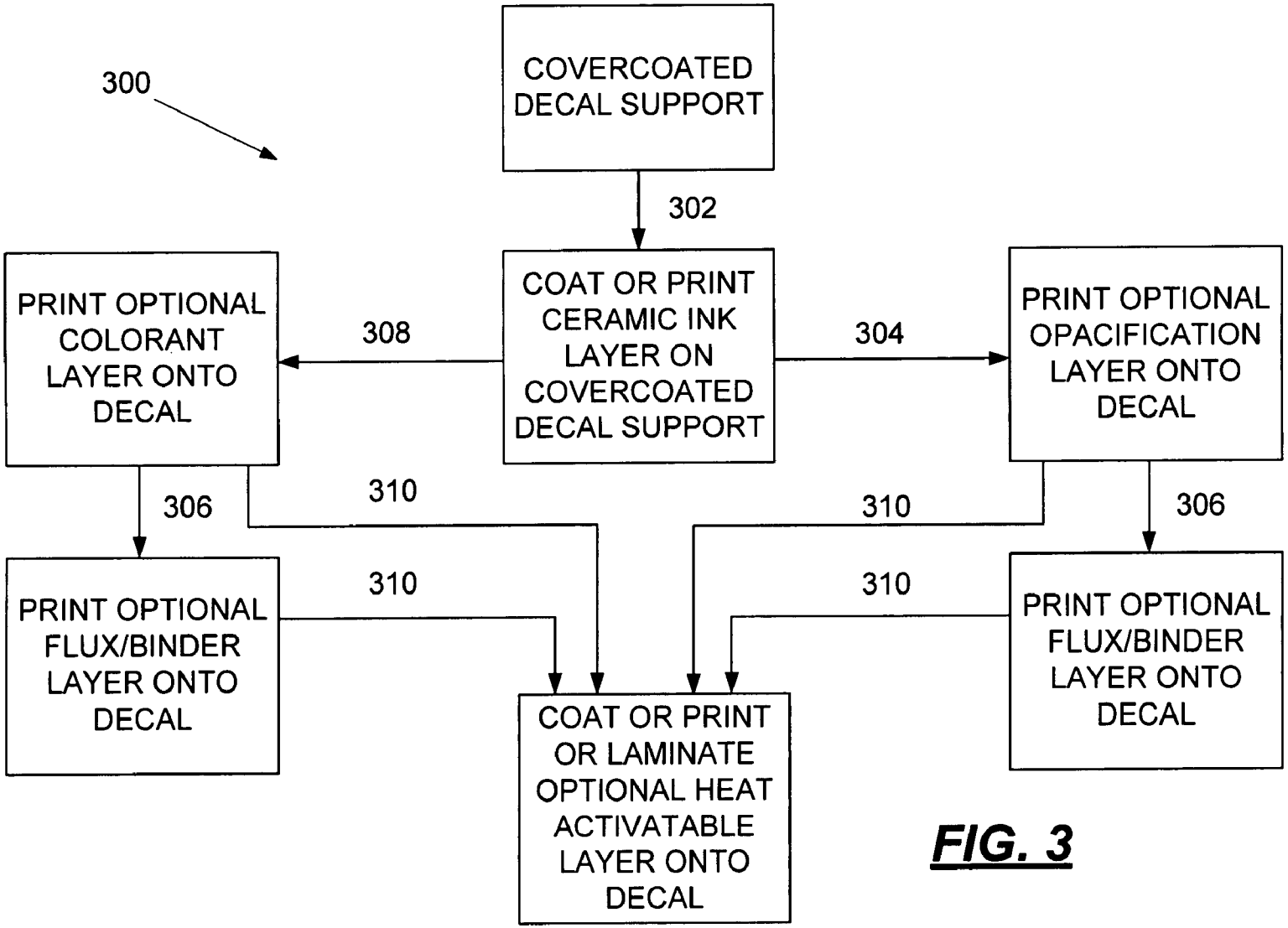
FIG. 3 is a flow diagram illustrating one method for producing a ceramic decal.

FIG. 3 is a schematic diagram of one process 300 for producing a ceramic decal. In process 300 a covercoated decal support is provided; these decal supports are, for example, described in U.S. Pat. No. 6,766,734. The decal support may be a paper or film and the covercoat is comprised of 15 weight percent to 100 weight percent of a carbonaceous binder. A frit and binder layer may be either coated or printed on the face of the covercoated decal support in optional step 302. In step 304, one may optionally print or coat an opacification layer. Such layers are described in U.S. Pat. No. 6,481,353. This may be further overprinted or overcoated with an optional frit/binder layer in step 306. It is also possible to use a ceramic ink layer which maybe optionally printed or coated onto the decal support as shown in step 308. Step 308 may optionally be followed by step 306. Step 308 and/or step 306 may be repeated one or more times to add a variety of colorants and other layers to the ceramic decal. In step 310, an optional heat activatable layer may be printed or coated or laminated onto the imaged, covercoated transfer sheet.

In one embodiment, the imaged, covercoated transfer sheet is subsequently used to transfer the ceramic image from the covercoated transfer sheet to a substrate to form an imaged substrate. The image may take the form of variable information (such as a lot number, a serial number, an identification number, a date, a bar code and the like), a name, logo, trademark, bug, make, model, manufacturer and the like, and/or an image, photograph, decoration, drawing, design, pattern and the like.

In one embodiment, the image is transferred from the imaged, covercoated transfer sheet to the substrate using a lamination process comprised of heat and pressure to form an imaged substrate.

In another embodiment, a vacuum autoclave process may be used to transfer the image from the imaged covercoated transfer sheet to the substrate using a process comprised of vacuum, heat and pressure. Such autoclave processes have been used for laminating thermoplastic films to glass and are described in U.S. Pat. Nos. 3,933,552; 4,624,731, and the like. The content of each of the aforementioned patents is hereby incorporated by reference into this specification.

The imaged substrate may be comprised of a ceramic substrate (such as, e.g., a substrate comprised of glass, porcelain, ceramic whiteware material, metal oxides, one or more clays, porcelain enamel, and the like). The imaged substrate may comprise non-ceramic material such as, e.g., natural and/or man-made polymeric material, thermoplastic material, elastomeric material, thermoset material, organic coatings, films, composites, sheets and the like.

Any substrate capable of receiving the imaged, covercoated transfer sheet of this invention may be used herein.

Figure 4:
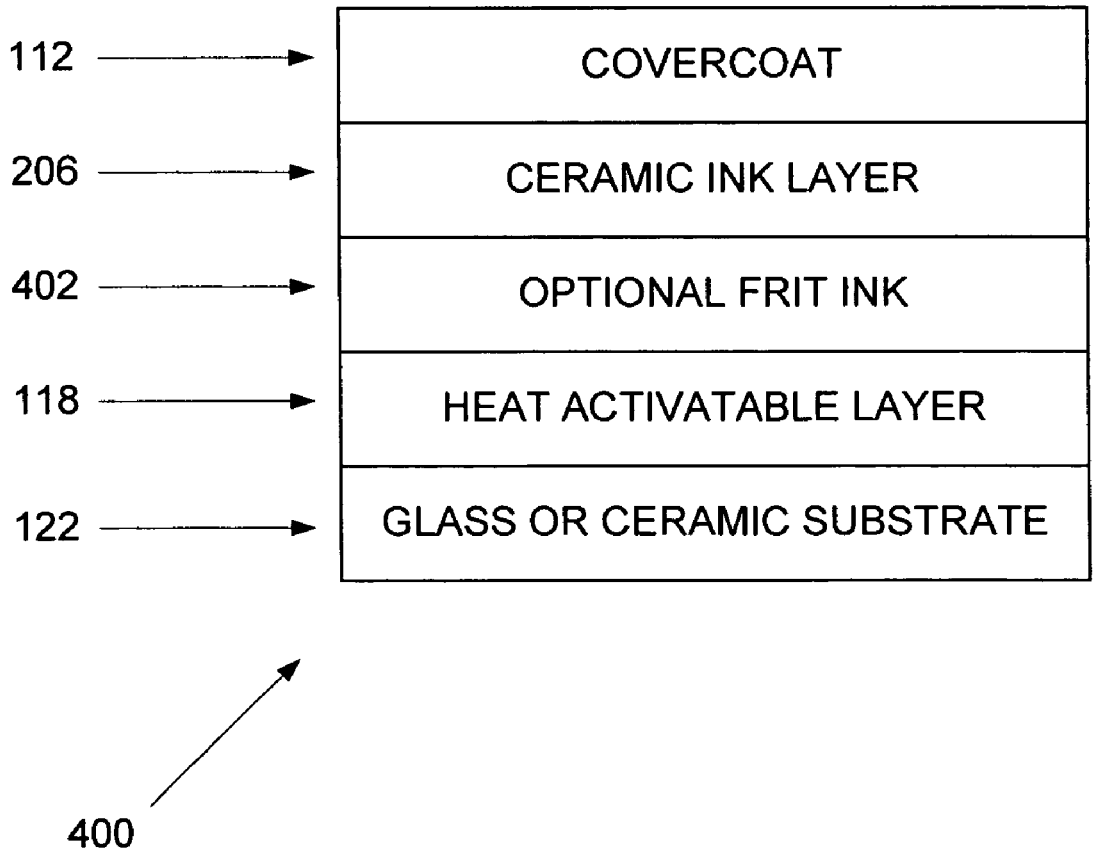
FIG. 4 is a cross-section of an imaged substrate of the present invention.

FIG. 4 shows a cross-sectional representation of an imaged substrate 400. The image substrate is comprised of a glass or ceramic substrate 122, a heat activatable layer 118, an optional frit ink 402, a ceramic ink layer 206 and a covercoat 112.

Referring again to FIG. 4, in one embodiment the imaged substrate 400 may be heat treated to permanently affix the digital ceramic image to the substrate. In this process, the carbonaceous material in the covercoat 112, ceramic ink layers 206, frit ink layers 402 and heat activatable layers 118 are volatilized through a process of thermal oxidation and removed from the digital ceramic image. Heat from the process also softens the glass frit in the digital ceramic image, causing it to flow and adhere to the substrate. The frit may also encapsulate any opacifiers and/or colorant which may be present in the ceramic image, and thus promote bonding to the substrate.

Figure 5:
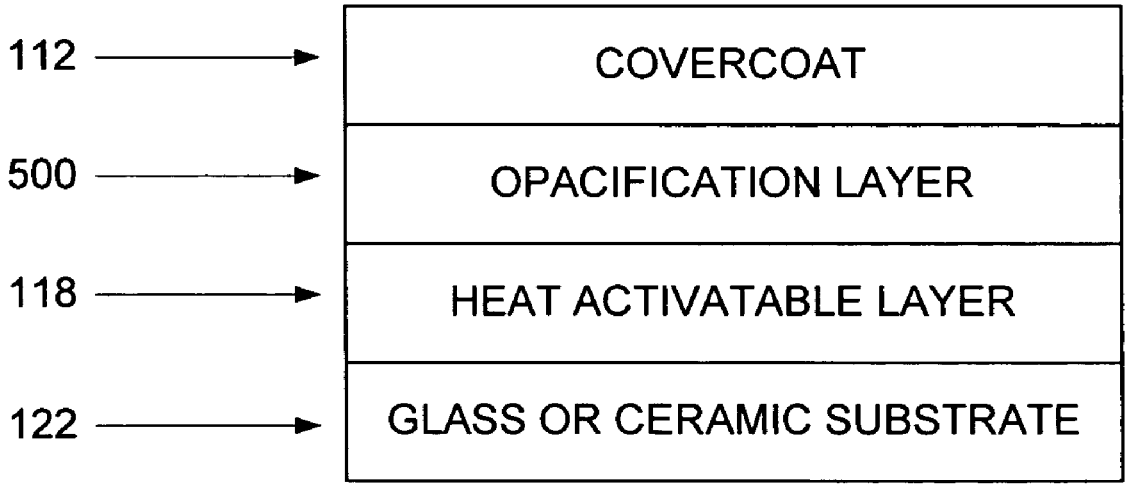
FIG. 5 is another cross-sectional diagram of a substrate laminated with a ceramic image.

FIG. 5 is a schematic diagram of one coated substrate of the invention which may be produced with the process of FIG. 3. In the embodiment depicted in FIG. 5, substrate 122 is bonded to opacificaton layer 500 and covercoat 112 using heat activatable layer 118.

Figure 6:
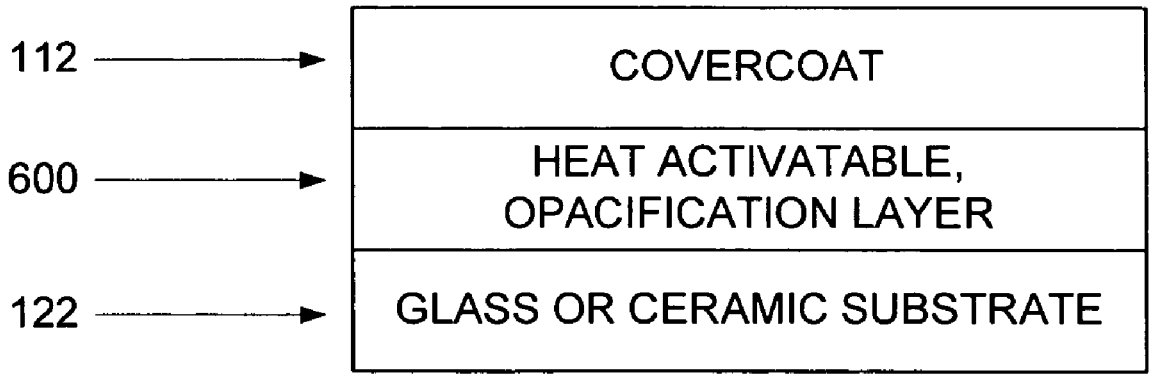
FIG. 6 is another cross-sectional diagram of a substrate laminated with a ceramic image.

In the embodiment depicted in FIG. 6, the heat activatable materials are disposed within heat activatable, opacification layer 600. Thus, in the embodiment depicted in FIG. 6, there is no discrete heat activatable layer.

Figure 7:
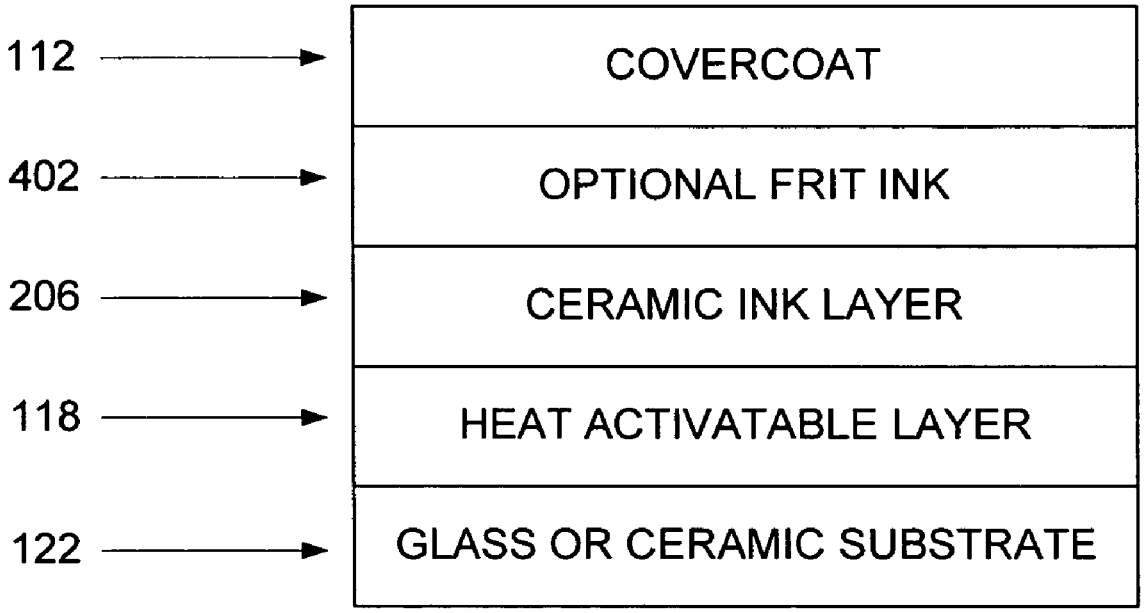
FIG. 7 is a cross-sectional diagram of another imaged substrate of the invention.
Figure 8:
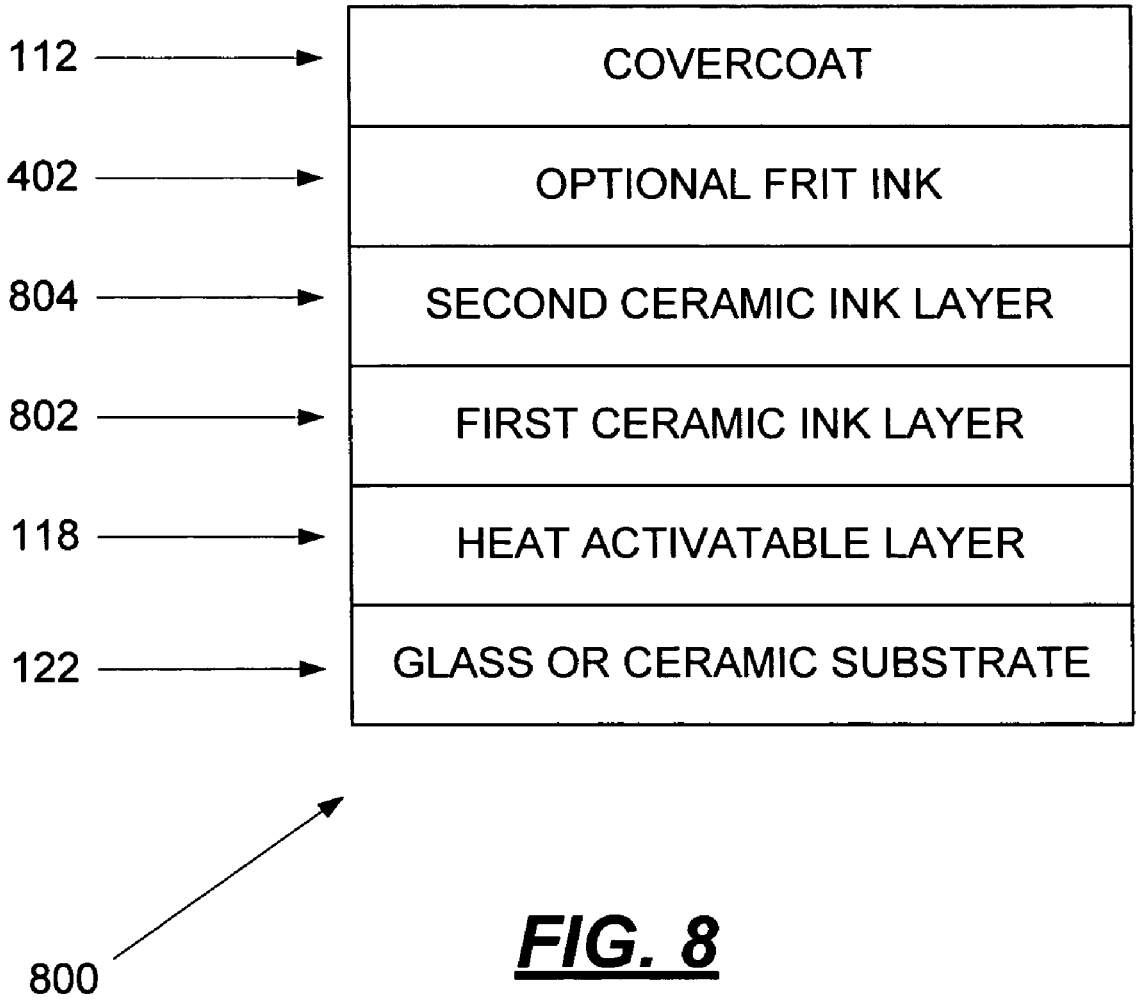
FIG. 8 is a cross-sectional diagram of another imaged substrate of the invention.

FIG. 7 and FIG. 8 are schematic illustrations of two coated substrates of the present invention which may be produced using the process illustrated in FIG. 3. In the embodiment depicted in FIG. 7, covercoat 112 is printed with frit ink 402. Thereafter, ceramic ink layer 206 is disposed over selected portions of the frit ink 402. In one embodiment, a thermal printing process is used to perform the step of disposing the ceramic ink layer 206 on the frit ink 402. Thereafter, heat activatable layer 118 is disposed over the ceramic ink layer 206. The resulting assembly is thereafter affixed to glass or ceramic substrate 122. In the embodiment depicted in FIG. 7, only a single ceramic ink layer 206 is present. Additional colorant layers may also be employed.

FIG. 8 is an illustration of one such embodiment, wherein more than one ink layer is employed. As illustrated in FIG. 8, imaged substrate 800 is comprised of first ceramic ink layer 802 and second ceramic ink layer 804. As would be apparent to one skilled in the art, additional ceramic ink layers, frit layers, and/or opacification layers may be used.

The glass film-forming frit should have a softening point below the temperature of the heat treating process used. In one embodiment, where the heat treating process is a glass tempering process, the substrate is typically heated to about 680° C. In this case, the glass frit should have a softening point or glass transition temperature less than 650° C. and preferable less than 625° C.

The glass frit should have a viscosity low enough in the heat treating process that it may flow to form a semi-porous film of glass with good wetting and adhesion to the substrate within the time limits of the process. Ideally, the time for the frit to flow and form a semi-porous film of glass is less than two minutes.

The frit should have a particle size distribution such that essentially all of the frit particles are less than 20 microns in size. Ideally, at least 90 percent of the frit particles should be less than 10 microns in average diameter. Smaller frit particles pack more densely and require less time and temperature to flow out to form a glass film. Also, smaller glass frit particles may more easily wet out and encapsulate opacifier and colorant particles.

The frit should flow out and wet the substrate; ideally, all of the substrate is covered with the glass film. Holes and voids in the glass film can degrade the appearance of the imaged substrate. In addition, if any opacifers or colorants are present in the ceramic image, they should be uniformly distributed in the glass film to achieve the desired level of opacity and color. The uniformity of color and the level of opacity should be comparable to that of the imaged substrate before the heat treating process. Those skilled in the art will understand that the particle size of the opacifers and colorants can have an impact on the opacity and color of the final image. These particles generally need to be smaller than 20 microns in diameter. However, if the particle size is too small, performance of these particles may be affected. For example, if the particle size of the opacifier is below 0.1 microns, its ability to scatter visible light will be diminished as well as the opacity which it imparts to the final image. Ideally, opacifer particles should be in the range of 0.1 micron to 10 microns.

Figure 9:
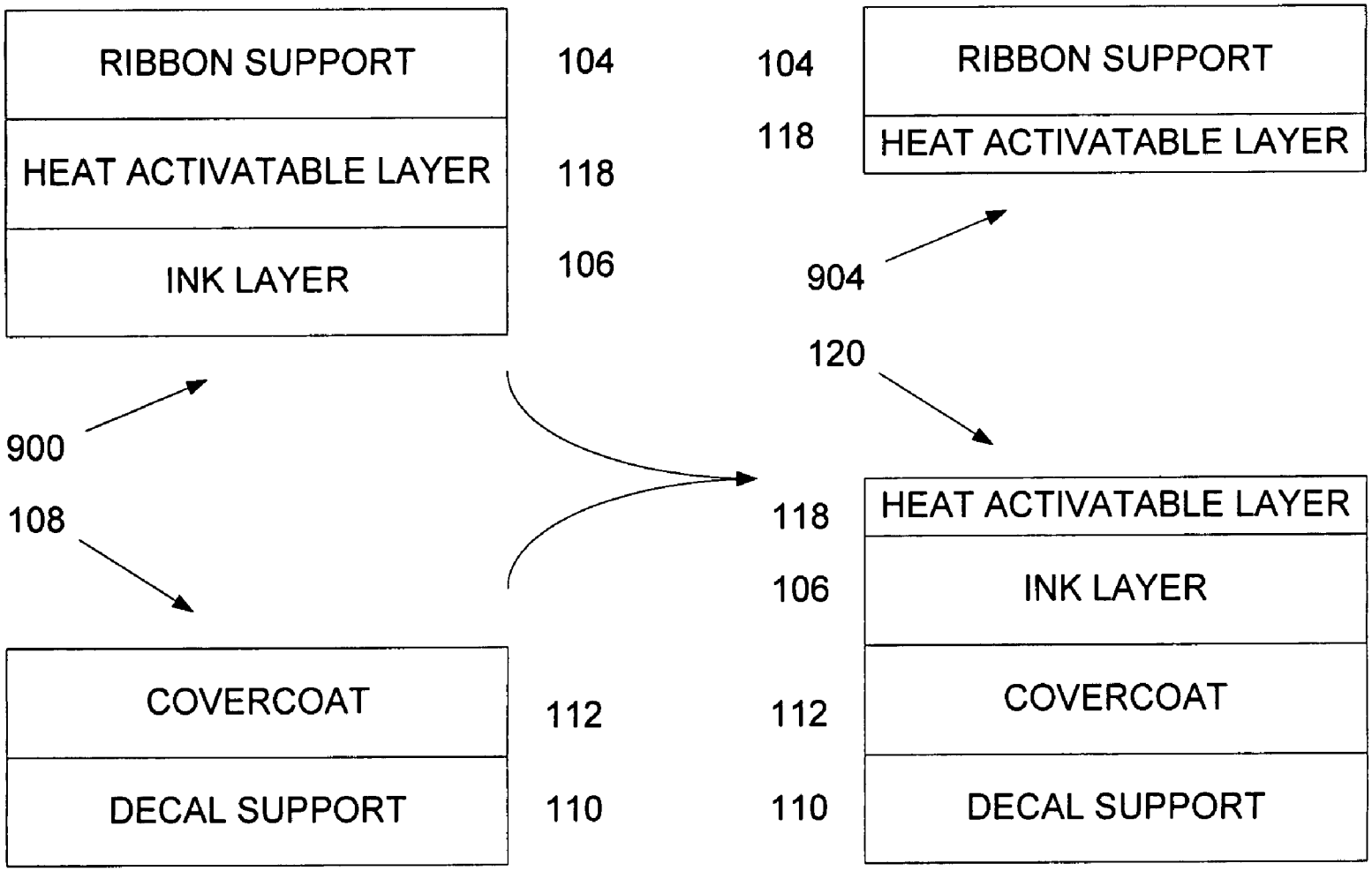
FIG. 9 is a flow diagram illustrating one method for producing a ceramic decal.

FIG. 9 is an illustration of one process for forming decal 120. In the embodiment depicted in FIG. 9, an imaging thermal transfer ribbon 900 is used to transfer a ceramic image to covercoated transfer sheet 108. In the embodiment depicted, thermal transfer ribbon 900 is comprised of ribbon support 104, heat activatable layer 118, and ink layer 106. In one embodiment, ink layer 106 is a ceramic ink layer comprised of ceramic colorant. Covercoated transfer sheet 108 is comprised of decal support 110 and covercoat 112. Thermal transfer ribbon 900 thermally transfers ink layer 106 and at least a portion of heat activatable layer 118 to covercoat 112, thus producing thermal transfer ribbon 904 and decal 120. It is preferable that a substantial portion of heat activatable layer 118 be transferred to decal 118, but, in some embodiments, residual heat activatable layer 118 remains on thermal transfer ribbon 904. Such decal 120 may be placed on a substrate to form a decal assembly.

Figure 10:
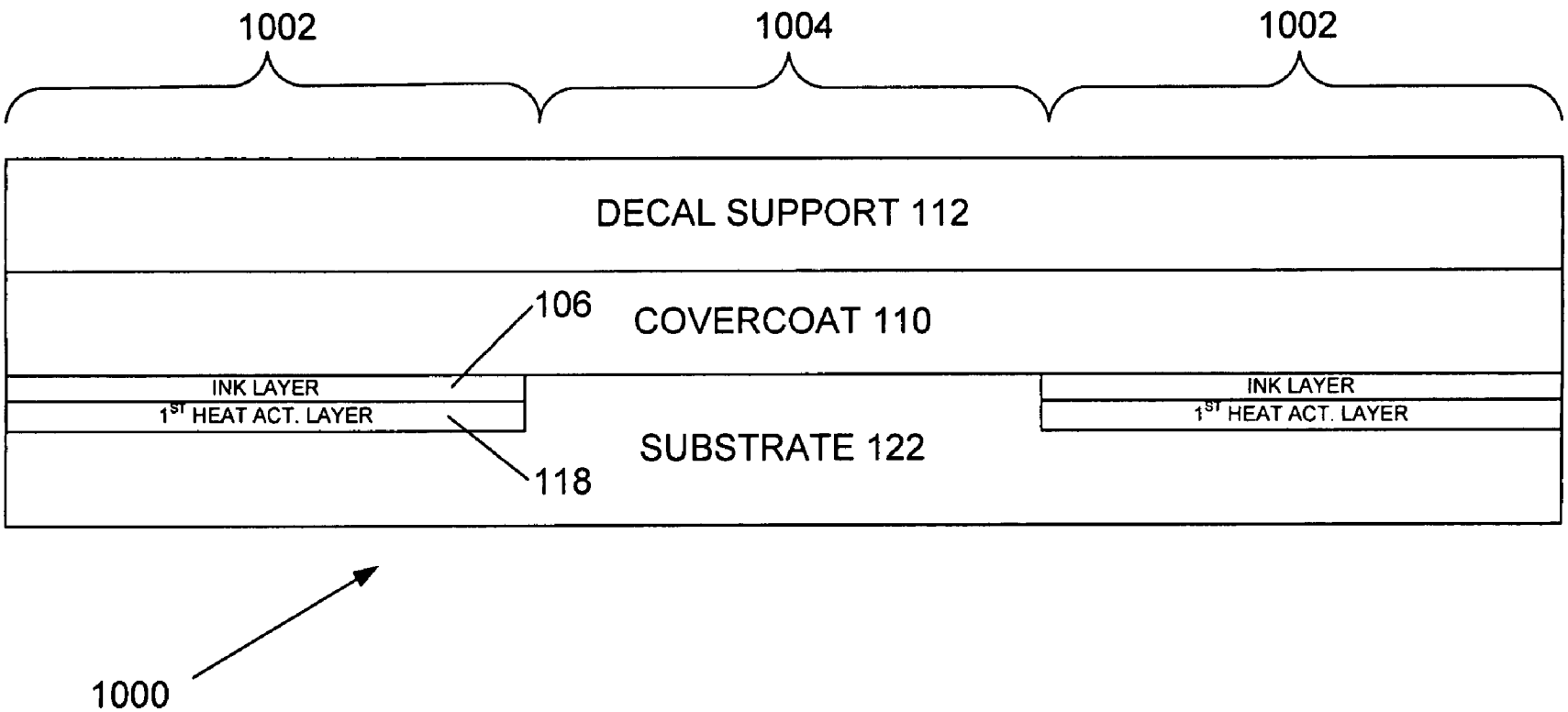
FIG. 10 is a flow diagram illustrating one method for producing a ceramic decal assembly.

FIG. 10 is an illustration of one decal assembly 1000 of the present invention. As would be apparent to one skilled in the art, when ink layer 106 is deposited on covercoat 110, such an ink layer may be deposited non-uniformly. In this manner, an image substrate is produced. Such an imaged substrate is comprised of imaged sections 1002 (wherein one or more image layers are present) and non-imaged sections 1004 (wherein substantially no image layer is present). In the embodiment depicted, the decal is adhered to the substrate 122 through the adhesive properties of first heat activatable layer 118. In such an embodiment, the first heat activatable layer is present only in imaged section 1002. In another embodiment, a second heat activatable layer is present in both imaged section 1002 and non-imaged section 1004.

Figure 11:
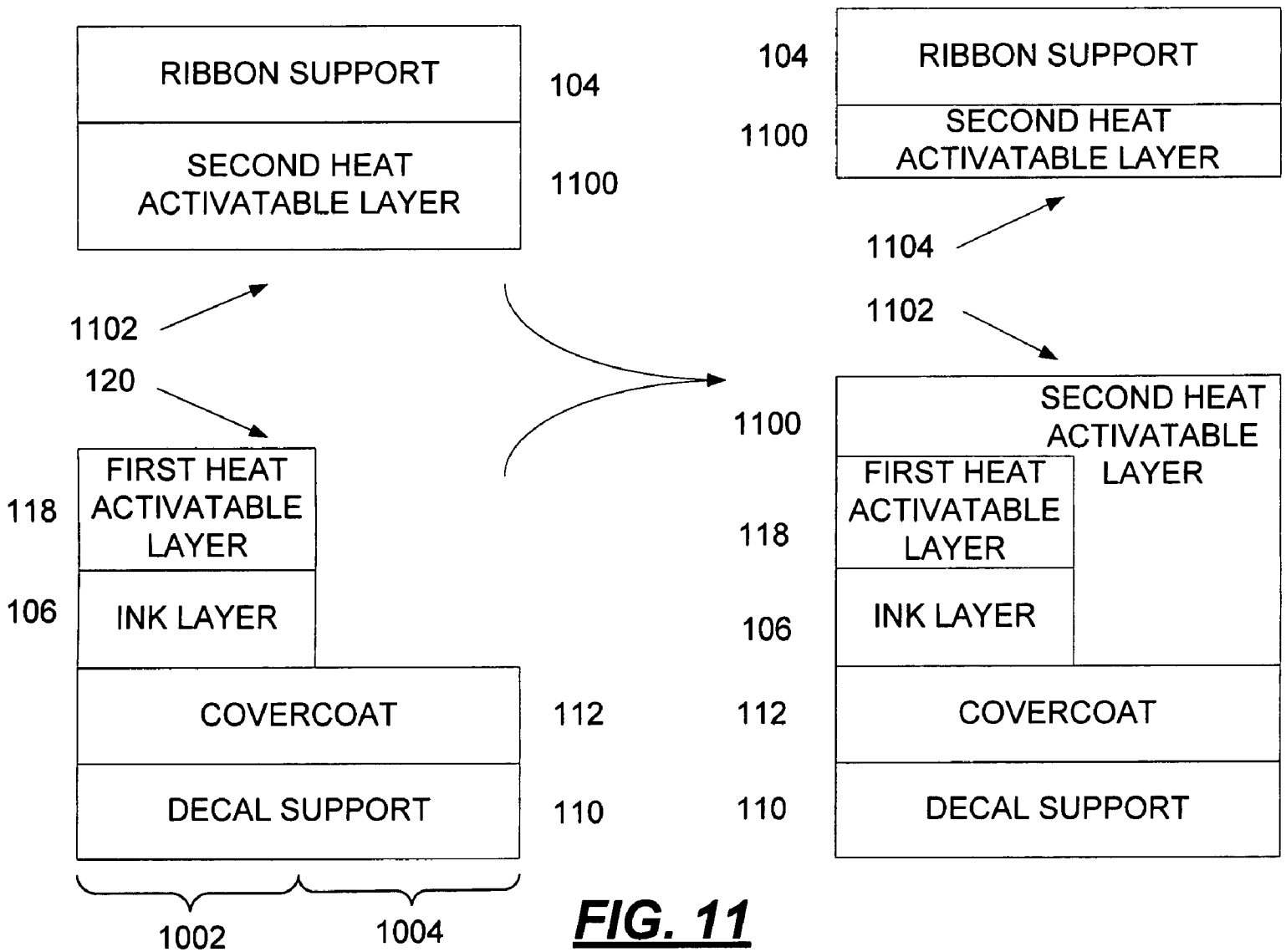
FIG. 11 is a flow diagram illustrating one method for producing a ceramic decal.

FIG. 11 depicts another embodiment of the present invention wherein such a second heat activatable layer is used. Overcoating thermal transfer ribbon 1102 is comprised of ribbon support 104 and second heat activatable layer 1100. Decal 120 is comprised of imaged section 1002, which is comprised of ink layer 106, first heat activatable layer 118, covercoat 112, and decal support 110. Decal 120 is further comprised of non-imaged section 1004 which is comprised of covercoat 112 and decal support 110. In the embodiment depicted, second heat activatable layer 1100 is thermally transferred to decal 120, thus producing decal 1102 and overcoat thermal transfer ribbon 1104. In the embodiment depicted, decal 1102 shows second heat activatable layer 1100 is transferred non-uniformly (i.e. thicker over non-imaged section 1004 and thinner over imaged section 1002). In another embodiment, shown in FIG. 12, second heat activatable layer 1100 is transferred uniformly.

Figure 12:
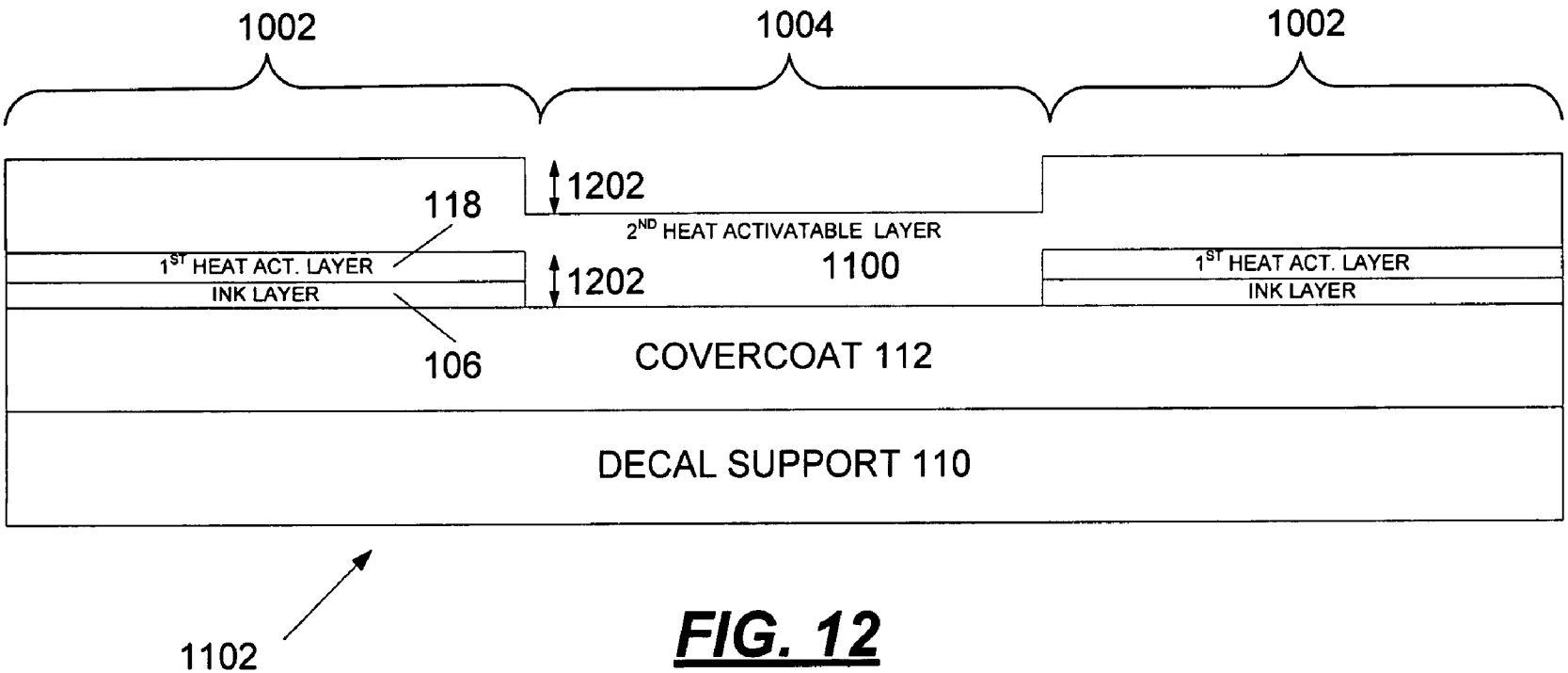
FIG. 12 is a cross-sectional diagram of another decal of the invention.

FIG. 12 is a depiction of decal 1102 wherein second heat activatable layer 1100 is transferred uniformly. In the embodiment depicted, distance 1202 is due to the presence of ink layer 106 and first heat activatable layer 118. Such distances are usually negligible. The magnitude of distance 1202 shown in FIG. 12, like the depth of the other layers, has been exaggerated for clarity of illustration. In the embodiment depicted in FIG. 13, such a gap is not shown.

Figure 13:
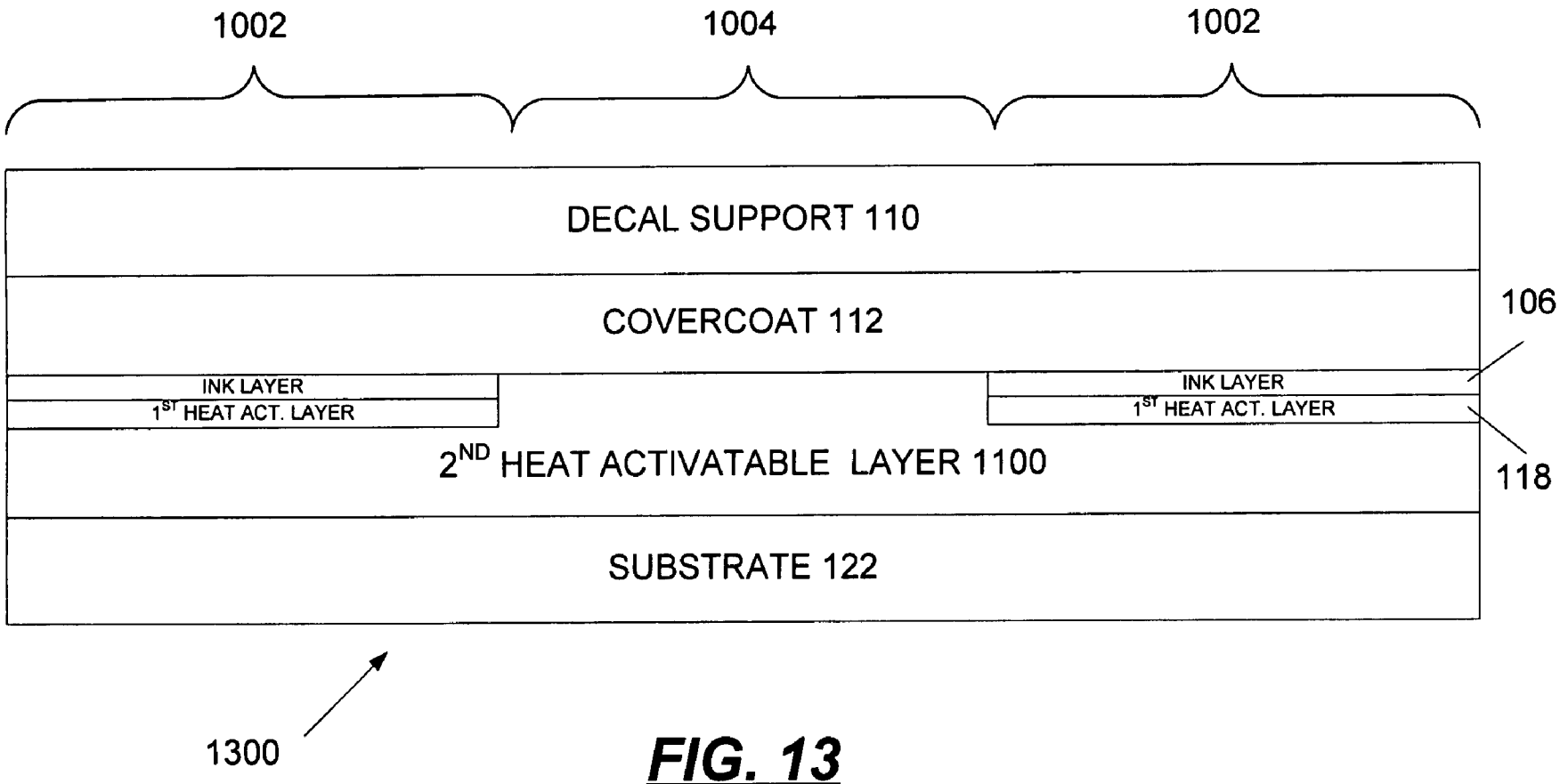
FIG. 13 is a cross-sectional diagram of another decal assembly of the invention.

FIG. 13 illustrates decal assembly 1300. Decal assembly 1300 is similar to decal assembly 1000, shown in FIG. 10, except in that a second heat activatable layer 1100 is present. In the embodiment depicted, the decal is adhered to the substrate 122 through the adhesive properties of second heat activatable layer 1100. Since the second heat activatable layer 1100 has much larger surface area than first heat activatable layer 118, it contacts substrate 122 with a much greater contact surface. This larger contact area promotes adhesion of the decal to substrate 122.

Figure 14:
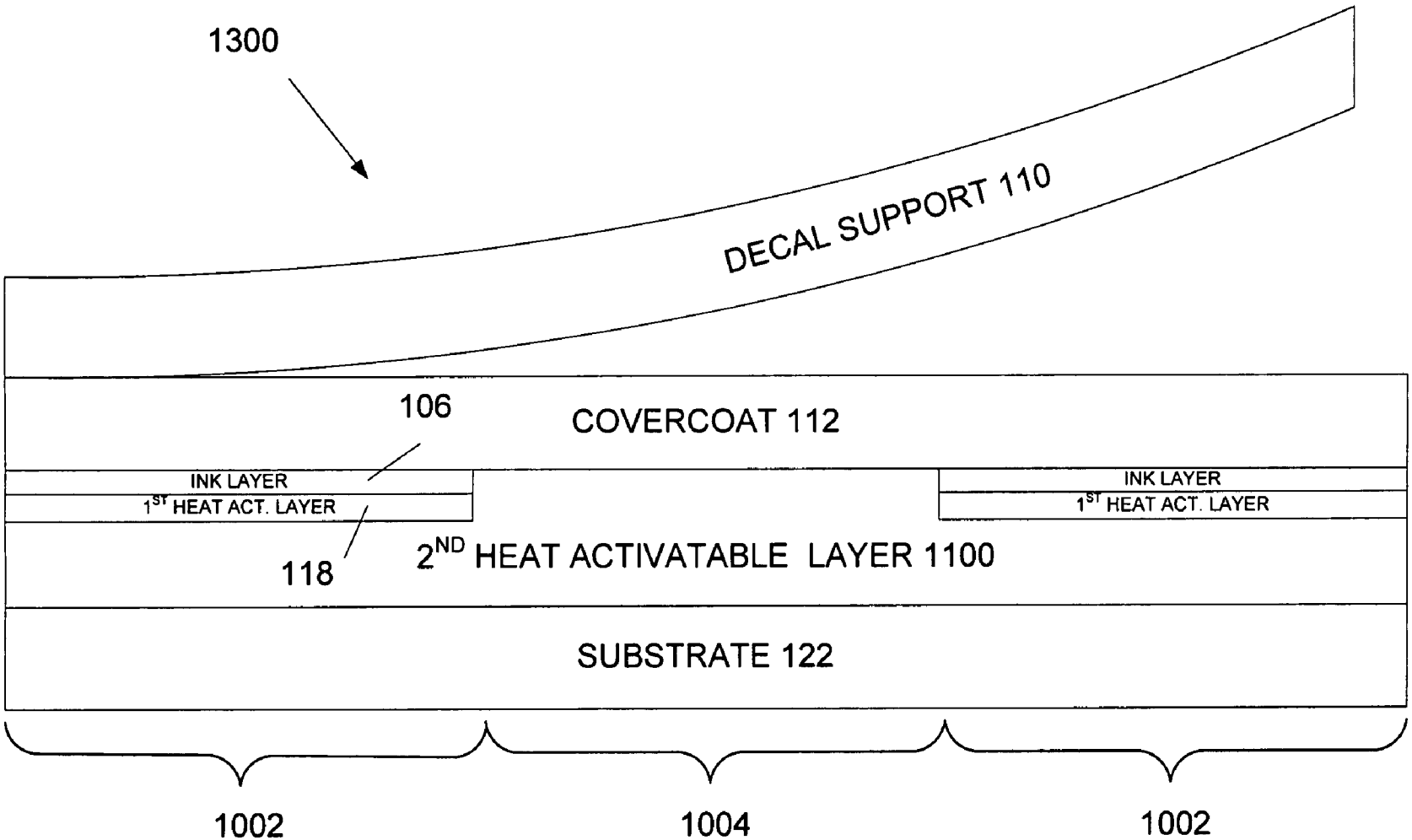
FIG. 14 is a cross-sectional diagram of another decal assembly of the invention.
Figure 15:
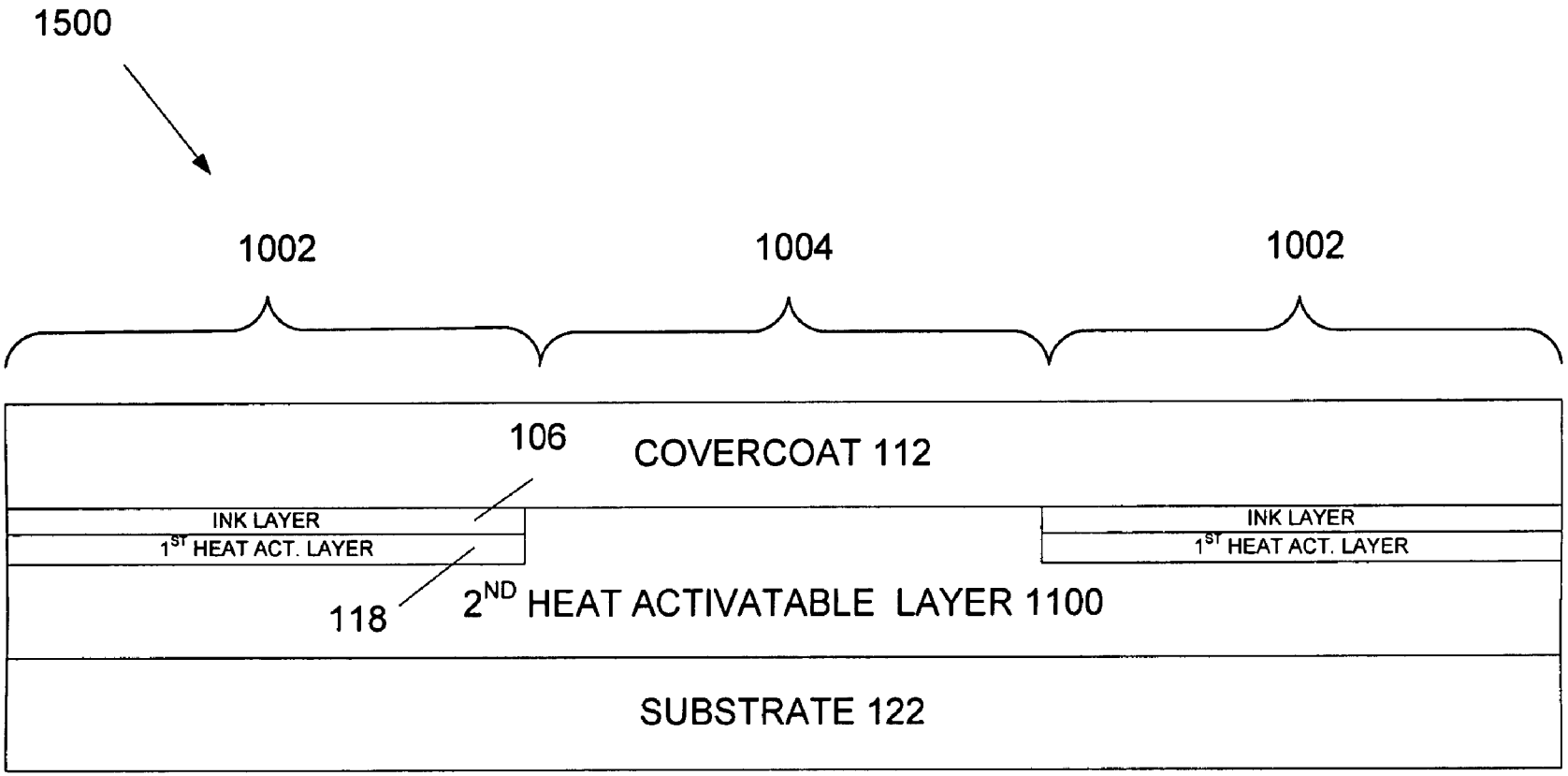
FIG. 15 is a cross-sectional diagram of an imaged substrate of the invention.

FIG. 14 shows the removal of decal support 110 from decal assembly 1300. In the embodiment depicted in FIG. 14, decal support 110 is removed from covercoat 112 by applying a peel force. In one embodiment, such a peel force is from about 1 to about 50 g/cm. In a preferred embodiment, such a peel force is less then about 30 g/cm. Once the decal support 110 is removed, imaged substrate 1500 is formed. Reference may be had to FIG. 15.

Figure 16:
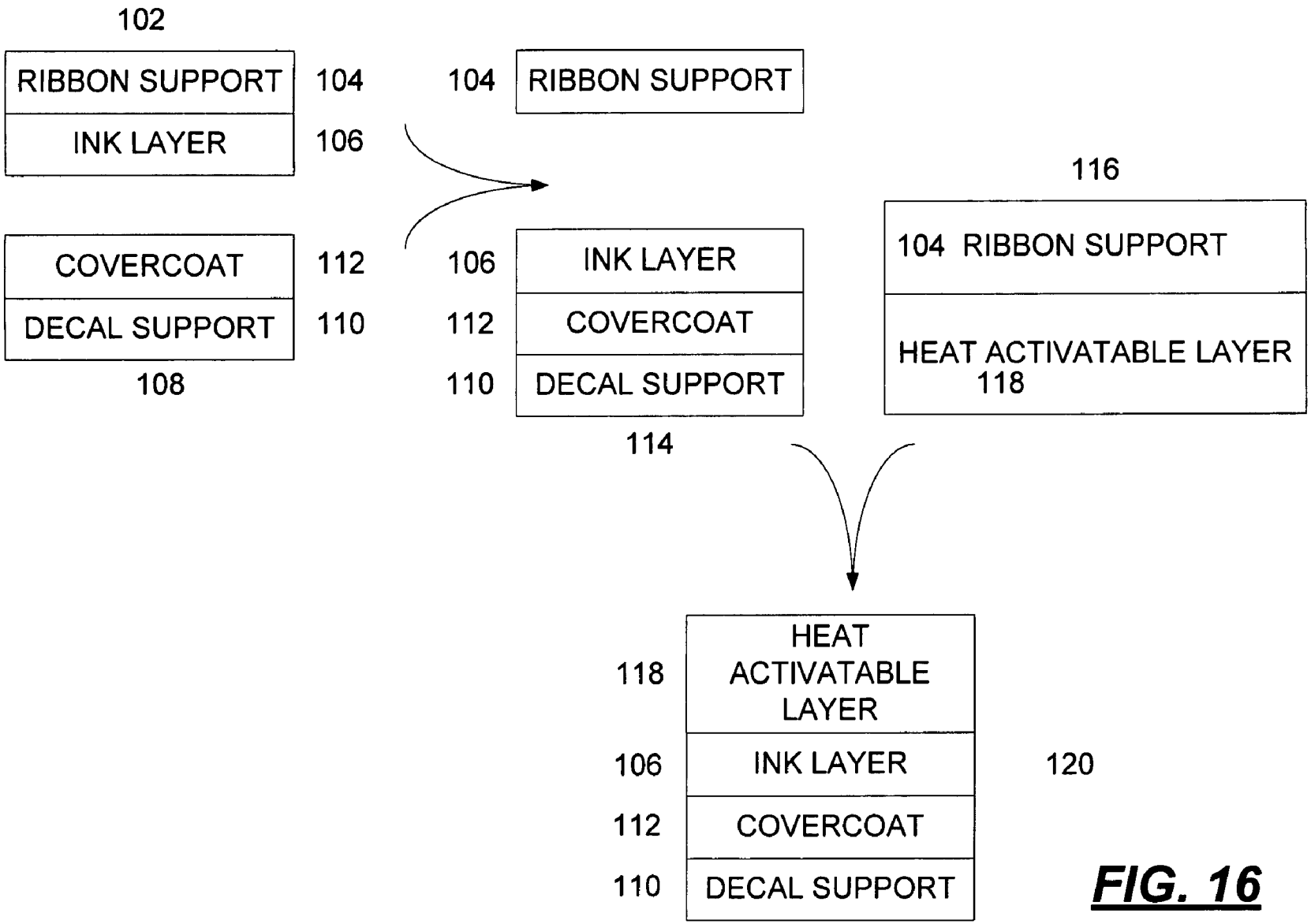
FIG. 16 is a flow diagram illustrating one method for producing a ceramic decal.

Referring now to FIG. 16, and the embodiment depicted therein, thermal transfer ribbon 102 is comprised of ribbon support 104 and ink layer 106. In the embodiment depicted, thermal transfer ribbon 102 lacks a heat activatable layer, such as heat activatable layer 118 depicted in FIG. 9. Thus, when ink layer 106 is printed onto covercoated transfer sheet 108, no heat activatable layer is present in imaged, covercoated transfer sheet 114. The heat activatable layer is subsequently transferred to the substrate with overcoat thermal transfer ribbon 116. In one embodiment, such a heat activatable layer is transferred to both the imaged sections and the non-imaged sections of decal 120. After application of the decal to a substrate (not shown) and subsequent removal of decal support 110, imaged substrate 1700 is formed (see FIG. 17).

Figure 17:
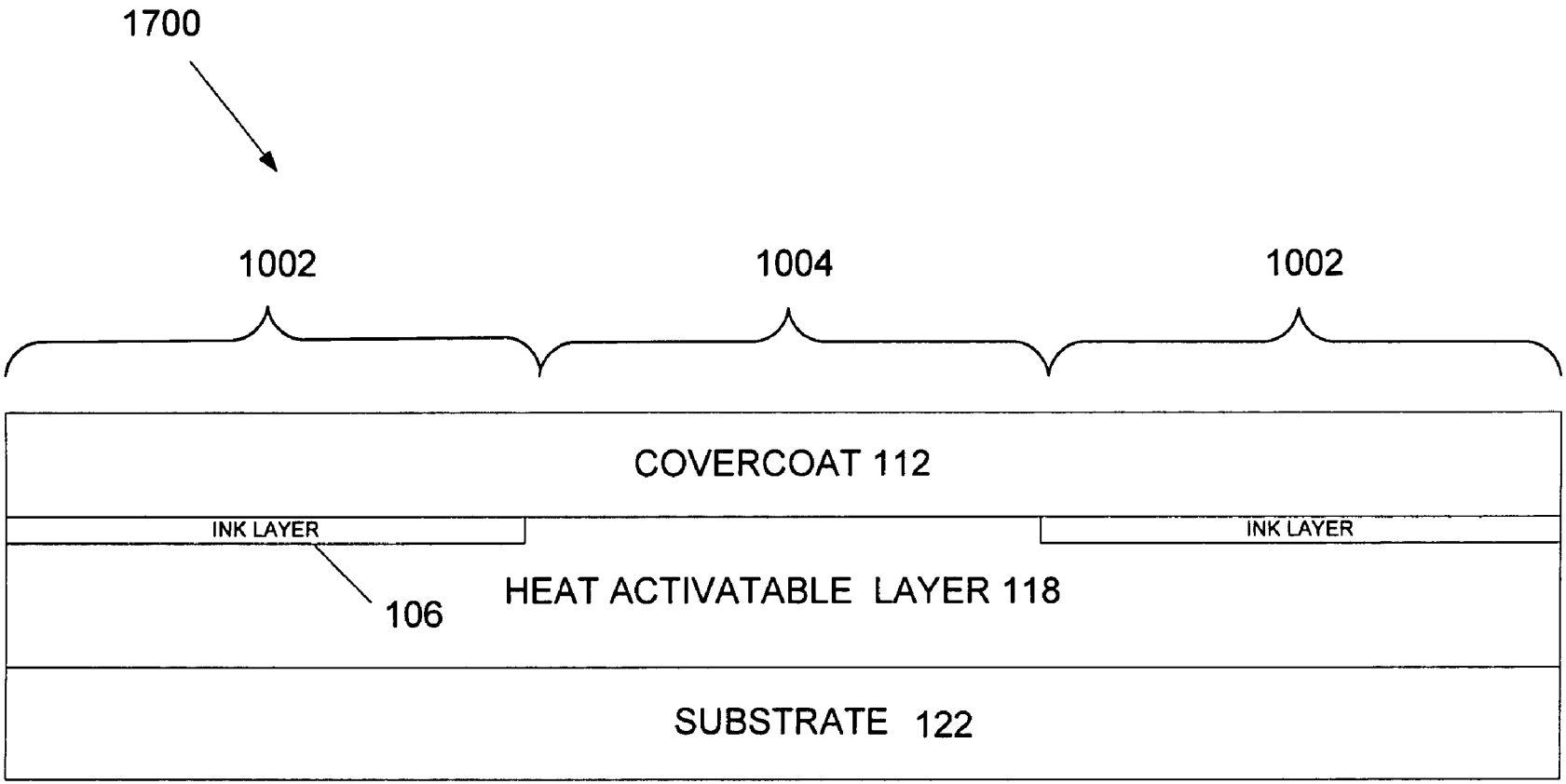
FIG. 17 is a cross-sectional diagram of another imaged substrate of the invention.

As shown in FIG. 17, imaged substrate 1700 is comprised of imaged sections 1002 and non-imaged sections 1004. Both of these sections are comprised of a single heat activatable layer 118. In such an embodiment, and in contrast to the embodiment illustrated in FIG. 15, imaged section 1002 lacks a second heat activatable layer.

Acid Resistance of Imaged Substrate

Often times, glass and ceramic substrates are cleaned with mildly acidic solutions. Some borosilicate frits are partially soluble in weakly acidic solutions. Prior art imaged substrates prepared with thin, fused films of such frits are quickly damaged when exposed to acidic cleaning solutions. The porosity of such fused films can impact the resistance of the imaged substrate to acid. During the heat treating process, which is used to permanently affix the digital ceramic image to the substrate, the frit should flow out and form a semi-porous glass film. The less porous this glass film is, the more resistant the image will be to damage from acid. The composition of the glass frit will also influence its resistance to acid etching. For example, glass frits high in silicon dioxide have good acid etch resistance. The composition of the glass frit should be selected such that after heat treating the imaged substrate, it remains essentially undamaged when exposed for 5 minutes to a 10% citric acid solution at 20° C.

The properties of the glass frit (softening point, wetting, acid resistance, etc.) are determined by the composition of the frit. Frits are amorphous solids prepared from various metal oxides. For example the following patents describe a wide range of glass frit mixtures: U.S. Pat. Nos. 5,753,571; 5,827,790; 5,665,472; 5,643,636; 5,326,591; 5,252,521; 4,970,178; 4,892,847; 4,554,258 and 4,537,862. These patents describe glass frits comprised of the various metal oxides, for example, $Bi_2O_4$, $SiO_2$, $B_2O_3$, ZnO, $Al_2O_3$, PbO, $MoO_3$, $V_2O_5$ and the like.

EXAMPLES

The follow examples illustrate some preferred aspects of applicants' decals. The following Examples are presented to illustrate a portion of the claimed inventions but are not to be deemed limitative thereof. Unless otherwise specified, all parts are by weight, and all temperatures are in degrees Celsius.

The examples below describe a variety of ceramic inks, overprints and heat activatable layers as a part of the imaged covercoat to improve adhesive transfer to the glass and ceramic substrates. They describe, in part, materials and/or reagents that are also described in U.S. patent application Ser. No. 10/621,976, the contents of which is hereby incorporated by reference into this specification.

Example #1

In this example a covercoated transfer sheet was prepared with a flexible substrate. The flexible substrate was a 90 gram per square meter basis paper made from bleached softwood and hardwood fibers. The surface was sized with starch. The face side of the base paper was then resin coated with a 20 gram per square meter thick layer of polyethylene using an extrusion coating process. A covercoat coating composition was prepared for application to the face coat of the flexible paper substrate. The cover coat was prepared by coating Joncryl 617 (a styrene/acrylic emulsion sold by Johnson Polymers, Racine, Wis.) at a dry coat weight of 15 grams per square meter using a Meyer rod. The coated paper was then allowed to dry at ambient temperature for 16 hours.

In this example a thermal transfer ribbon was prepared for printing onto covercoated transfer paper. The ceramic ink to be coated on the thermal transfer ribbon was prepared by mixing 18.27 grams of hot toluene with 6.59 grams of the methacrylate Dianal BR113 (Dianal America, Pasadena, Tex.), 1.62 grams of the ethylene vinyl acetate Elvax 250 (Dupont, Wilmington, Del.), and 0.49 grams of the polyamide gellant, Uniclear 100 (Arizona Chemical). These components were allowed to dissolve completely and then cooled to ambient temperature. Subsequently, 3.45 gram of dioctyl phthalate (Chemcentral, 3709 River Road Town of Tonawanda, N.Y.), 28.86 grams of the flux 20-8380 (Ferro Corp, Washington, Pa.), 5.32 grams of the Zirocn Opacifier Superpax Plus (Cookson-Matthey, Jacksonville, Fla.), 4.78 grams of the 94C1001 Flux (Johnson & Matthey, 498 Acorn Lane, Dowington, Pa.), and 0.79 grams of the Cerdec Black oxide 1795 (Cerdec/Ferro, Washington, Pa.) were added to the mixture. To the mixture was added 50 grams of ceramic milling media (0.6-0.8 mm). The mixture was milled on a Red Devil paint shaker until a 7 Hegman grind (particle size of 0-5 microns) was achieved. Then 24.31 grams of the 15% dispersion of alcohol modified paraffin wax Unilin 425 (Baker Petrolite, Sugarland, Tex.) in methyl ethyl ketone was added. The mixture was re-milled until a 7 hegman grind was achieved. The ceramic media was filtered out using a 400 micron nylon filter bag.

A backcoated thermal transfer film was prepared by applying a mixture of styrene acrylonitrile Lustran SAN33 (Bayer Polymers, 100 Bayer Rd. Pittsburgh, Pa.), Zinc Sterate (Zelller & Gmelin GMBH, Schloss-Strauss 201D-7332 Elislengenfils, Germany), Zelec NK (Dupont Corp, 1007 Market St., Wilmington, Del.) and Printex XE2 (Degussa Corp, 65 Challenger Rd., Ridgefield, N.J.) and Homogenol L18 (KAO Specialities Americas, 243 Woodbine St., High Point, N.C.) at a coatweight of 0.23 grams per square meter using a gravure coating process to a 5.7 micron thick poly (ethylene terepthalate) film (Toray Plastics America, Providence, R.I.).

The ceramic thermal transfer ink was then coated via a meyer rod to give a dry coat weight of 6.5 grams per square meter onto the uncoated side of the thermal transfer film. The ink was dried with a hot air gun until dry to the touch.

A ceramic decal was then prepared by printing the thermal transfer ribbon onto the covercoated transfer sheet with 4 images of rectangular boxes measuring 10 mm by 90 mm with 5 mm clear spaces in between each box. Each printed box had a unique tint level, box 1 was 100%, box 2 was 70%, box 3 was 30%, and box 4 was 10%. The ribbon was printed onto the decal using a Zebra 140Xii Thermal Transfer printer (Zebra Technologies, 333 Corporate Woods Parkway, Vernon Hills, Ill. 60061) at a printing speed of 2 ips (inches per second) and a darkness setting of 26. The subsequent decal was then placed image side down onto a 4" by 4" square piece of ¼" thick float glass. This decal-glass assembly was then placed onto the lower platen of a heat press (George C. Knight Co., Piscataway, N.J.). The top platen had been previously heated to 250° F. The top platen was then clamped down on top of the decal/glass assembly and allowed to heat for one minute. This heating time allowed the paper temperature to reach 185° F. Pressure on the top platen was then released and the top platen was raised up off the imaged glass assembly. The image/glass assembly was then allowed to cool to ambient temperature and the paper backing was removed manually. The image was then visually assessed for the percent adhesion within each of the tinted areas.

In this example the image adhesion to the glass substrate was 0% for the 100%, 70%, and 30% tint areas. In the 10% tint area only 5% of the image adhered.

Example #2

The process used in Example 1 was followed except the ceramic ink for this example was prepared by mixing 16.61 grams of hot toluene with 5.99 grams of methacrylate polymer Dianal BR113 (Dianal America, Pasadena, Tex.), 1.47 grams of ethylene vinyl acetate Elvax 250 (Dupont, Wilmington, Del.), and 0.45 grams of polyamide gellant, Uniclear 100 (Arizona Chemical). These components were allowed to dissolve completely and then cooled to ambient temperature. Subsequently, 3.14 gram of dioctylphthalate (Chemcentral, 3709 River Road Town of Tonawanda, N.Y.), 32.32 grams of flux 20-8380 (Ferro Corp, Washington, Pa.), 6.02 grams of Zirocn Opacifier Superpax Plus (Cookson-Matthey, Jacksonville, Fla.), 5.43 grams of 94C1001 Flux (Johnson & Matthey, 498 Acorn Lane, Dowington, Pa.) and 0.99 grams of Cerdec Black oxide 1795 (Cerdec/Ferro, Washington, Pa.) were added to the mixture. To the mixture was added 50 grams of ceramic milling media (0.3 mm). The mixture was milled on a Red Devil paint shaker until a 7 Hegman grind (particle size of 0-5 microns) was achieved. Then 22.10 grams of the 15% dispersion of alcohol modified paraffin wax Unilin 425 (Baker Petrolite, Sugarland, Tex.) in methylethylketone was added. The mixture was re-milled until a 7 hegman grind was achieved. The ceramic media was filtered out using a 400 micron nylon filter bag.

The procedure for making the decal is essentially the same as that described in example #1.

In this example the image had 0% adhesion at 100% tint, 75% adhesion at 70% tint, 50% adhesion at 30% tint and 100% adhesion at 10% tint.

Example #3

The process used in Example 2 was followed except a release layer ink was prepared by dissolving 0.58 grams of the Ceramer 1608 (an alpha-olefinic modified paraffin wax, sold by Baker-Petrolite, Sugarland, Tex.), 0.6 grams of the Evaflex 577 (an ethylene vinyl acetate sold by Dupont Mitsui and Polychemicals Company of Japan), and 3.82 grams of Polywax 850 (a polyethylene wax sold by Baker-Petrolite Company of Sugarland, Tex.) into 38 grams of reagent grade toluene and 57 grams of reagent grade isopropanol.

This release layer ink was then coated via meyer rod to achieve a dry coat weight of 0.5 grams per meter square onto the uncoated side of the backcoated polyester film.

The ceramic ink of Example 2 was then coated via a meyer rod on top of the release layer to achieve a dry coat weight of 6.5 grams per square meter to form a thermal transfer ribbon.

In this example the image had 100% adhesion at 100% tint, 75% adhesion at 70% tint, 30% adhesion at 30% tint and 5% adhesion at 10% tint.

Example #4

The process used in Example 3 was followed except a release ink was prepared by dissolving 0.58 grams of the Ceramer 1608 (an alpha-olefinic modified paraffin wax, sold by Baker-Petrolite, Sugarland, Tex.), 0.6 grams of the Evaflex 577 (an ethylene vinyl acetate sold by Dupont Mitsui and Polychemicals Company of Japan), and 3.82 grams of Polywax 850 (a polyethylene wax sold by Baker-Petrolite Company of Sugarland, Tex.) into 38 grams of reagent grade toluene and 57 grams of reagent grade isopropanol. This release ink was then coated onto the face side a back-coated polyester film and allowed to dry ambiently using a Meyer rod to achieve a dry coat weight of 0.5 grams per meter square. The ceramic ink Example 3 was coated onto the release coated side of the back-coated polyester film using a meyer rod to achieve a dry coat weight of 6.5 grams per square meter.

A thermal transfer ribbon with a printable, heat activatable layer was prepared for decal overprinting. This heat activatable thermal transfer ribbon was prepared with a 5.7 micron thick poly(ethylene terephthalate) film (Toray Plastics America, 50 Belver Avenue, North Kingstown, R.I. 02852) as the substrate film. The film was backcoated with a mixture of styrene acrylonitrile Lustran SAN33 (Bayer polymers, 100 Bayer Rd. Pittsburgh, Pa.), Zinc Sterate (Zelller & Gmelin GMBH, Schloss-Strauss 201D-7332 Elislengenfils, Germany), Zelec NK (Dupont Corp, 1007 Market St., Wilmington, Del.) and Printex XE2 (Degussa Corp, 65 Challenger Rd., Ridgefield, N.J.) and Homogenol L18 (KAO Specialities Americas, 243 Woodbine St., High Point, N.C.) at a dry coatweight of 0.23 grams per square meter. The backcoat was applied by gravure coating.

The heat activatable overprint ink was prepared by first making a mill-base using 85 grams of toluene and 15 grams of Polywax 500 (a polyethylene wax supplied by Baker Pertrolite, 12645 W. Airport Rd., Sugar Land Tex.). These components were milled via an attritor with steel ball media. The final overprint composition was then prepared by heating 53.55 grams of toluene to 70 C and stirring in 6.2 grams of the Elvax 40W (Dupont Polymers, 1007 Market St., Wilmington, Del.) and 6.2 grams of the Ceramer 67 (Baker Petrolite, 12645 W. Airport Rd., Sugar Land Tex.). Both materials were allowed to dissolve in the hot toluene. Thereafter 33.47 grams of the mill-base was stirred into this mixture. The mixture was then coated onto the polyester substrate at a dry coating weight of 2.0 gram per square meter using a gravure coating method.

A ceramic decal was then prepared by printing the ceramic ink onto the covercoated transfer paper as described in Example 1. The imaged transfer paper was then overprinted with heat activatable layer using the heat activatable ribbon describe in this example using a Zebra 140Xii Thermal Transfer printer (Zebra Technologies, 333 Corporate Woods Parkway, Vernon Hills, Ill. 60061) at a printing speed of 2 ips and a darkness setting of 26. The overprint was printed over the entire printed area of the decal. The ceramic heat activatable overprint, ceramic image and covercoating were then transferred off the decal and onto a glass substrate with a heat press as described in Example 1.

In this example the image had 100% adhesion at 100% tint, 100% adhesion at 70% tint, 100% adhesion at 30% tint and 100% adhesion at 10% tint.

Example #5

In this example a heat activatable overprint ribbon and a ceramic ink thermal transfer ribbon were prepared as described in Example 4. Heat transferable ceramic decals were then prepared these ribbons in a similar fashion to those described in Example 4 with the following exceptions: A ceramic decal was then prepared by printing the thermal transfer ribbon onto the covercoated transfer sheet with a set of 10 rectangular boxes measuring 30 mm by 60 mm with 5 mm clear spaces in between each boxes. Each box represented a step in tint strength between 10 percent tint and 100 percent tint, in increments of 10%. The ribbon was printed onto the decal using a Matan Spark Thermal Transfer printer (Matan Digital Printers, 11 Amal St., Rosh-Ha'ayin 48092, Israel) at a printing speed of 0.5 inches per second and a darkness setting of 26.

The heat activatable ribbon was then overprinted onto the decal in a solid fill contiguous layer also using a Matan Spark printer at an energy level of 28-32 and a print speed of 0.5 inches per second.

The overprinted decals were affixed to the glass substrate using a hot lamination process rather than a heat press. This was accomplished by placing the overprinted imaged decals image side down onto an 18" by 36" sheet of piece of 0.25 inch thick float glass using a thermally stable tape (3M 5413 polyimide tape). The tape was affixed to the glass and decal about 1 inch back and on both sides of the leading edge of the decal, making sure to keep the leading edge of the image under tension. The glass substrate and affixed decal were then evenly heated by shuttling the substrate back and forth 1 inch over IR heating lamps (Unitube lamps available from Casso-Solar Corporation, Pomona, N.Y.) which provide direct infrared radiation from below to heat the substrate and decal. The IR lamp output was 60 watts per ink, reaching a temperature of 1500° F. when energized at 480 volts. The glass substrate and affixed decal were shuttled back and forth across the bank of the lamps for approximately 12 minutes until the backside of the decal reached an temperature of 185-195° F. Once this temperature was achieved the glass substrate/decal assembly was laminated together.

The substrate/decal assembly was passed through a set of nip rollers to laminate the softened overprint to the glass. The top and bottom nip rollers were at ambient temperature (20° C.) and each had a diameter of 6 inches. The top nip roller had a Shore A durometer of 45. The bottom nip roller had a Shore A durometer of 65. The nip pressure was approximately 300 psi. When the substrate and affixed decal passed through the nip/lamination assembly, the top roller was compressed against the decal and substrate such that essentially all the air was squeezed out from between the glass substrate and decal, enabling a strong adhesive bond to form. The speed at which the substrate and affixed decal passed though the nip/lamination assembly was 1 meter per minute.

The glass substrate/decal assembly was then allowed to cool to below 160° F. and the decal paper backing is gently peeled off by hand leaving the overprint, fritted image and covercoat on the glass substrate. Each of the 10 tint strength boxes completely transferred to the glass substrate with 100% adhesion.

Example #6

In this example the ceramic ink thermal transfer ribbon of example 4 was used. The thermally activatable overprint ribbon of example 4 was used except the coating weight of the thermally transferable layer was 1.3 grams per square meter rather than 2.0 grams per square meter.

In this example the ceramic ink decal and lamination process of example 5 was used to transfer the heat activatable overprint, ceramic ink image and undercoat onto the glass substrate. In this example the image had 100% adhesion at 100%, 90%, 80%, 70%, 60% and 50% tint, at 40% tint the adhesion was 50%, at 30% tint the adhesion was 20% and at 20% tint to 10% tint the adhesion was 0%.

Example #7

A thermal transfer ribbon with a printable, heat activatable layer was prepared for decal overprinting. This heat activatable thermal transfer ribbon was prepared with a 5.7 micron thick polyethylene terephthalate film (Toray Plastics America, 50 Belver Avenue, North Kingstown, R.I. 02852) as the substrate film. The film was backcoated with a mixture of styrene acrylonitrile Lustran SAN33 (Bayer polymers, 100 Bayer Rd. Pittsburgh, Pa.), Zinc Sterate (Zelller & Gmelin GMBH, Schloss-Strauss 201D-7332 Elislengenfils, Germany), Zelec NK (Dupont Corp, 1007 Market St., Wilmington, Del.) and Printex XE2 (Degussa Corp, 65 Challenger Rd., Ridgefield, N.J.) and Homogenol L18 (KAO Specialities Americas, 243 Woodbine St., High Point, N.C.) at a dry coatweight of 0.23 grams per square meter. The backcoat was applied by gravure coating.

The heat activatable overprint ink was prepared by first making a mill-base using 85 grams of toluene and 15 grams of Polywax 500 (a polyethylene wax supplied by Baker Pertrolite, 12645 W. Airport Rd., Sugar Land Tex.). These components were milled via an attritor with steel ball media. The final overprint composition was then prepared by heating 53.55 grams of toluene to 70 C and stirring in 6.2 grams of the Elvax 40W (Dupont Polymers, 1007 Market St., Wilmington, Del.) and 6.2 grams of the Ceramer 67 (Baker Petrolite, 12645 W. Airport Rd., Sugar Land Tex.). Both materials were allowed to dissolve in the hot toluene. Thereafter 33.47 grams of the mill-base was stirred into this mixture along with 0.15 grams of Finsil (Tokuyama Corp., 1-1 Mikage-cho, Tokuyama Yamaguchi, 745 Japan). The mixture was then coated onto the polyester substrate at a dry coating weight of 2.0 gram per square meter using a gravure coating method.

In this example the ceramic ink decal and lamination process of Example 5 was used to transfer the heat activatable overprint, ceramic ink image and undercoat onto the glass substrate. In this example the image had 100% adhesion in all 10 of the tint strength boxes.

Example #8

In this example the thermal transfer ribbon of Example 5 was used. The heat activatable overprint ribbon of Example 5 was also used with the exception that the overprint was prepared as above except the Polywax 500 was omitted, the Ceramer 67 was used at 14.64 grams, the Elvax 40W was replaced with Elvax 250 at 0.98 grams. In this example the ceramic ink decal and lamination process of Example 5 was used to transfer the heat activatable overprint, ceramic ink image and undercoat onto the glass substrate. In this example the image had 100% adhesion at 100, 90, 80, 70, 60, 50 and 40% tints. At 30% tint the adhesion was 30%. At 20 and 10% tints the adhesion was 10%.

Example #9

In this example the thermal transfer ribbon of Example 5 was used. The heat activatable overprint ribbon of Example 5 was also used with the exception that the Polywax 500 was omitted, the Ceramer 67 was used at 14.11 grams, and the Elvax 40W was replaced with Elvax 250 at 0.74 grams.

In this example the ceramic ink decal and lamination process of Example 5 was used to transfer the heat activatable overprint, ceramic ink image and undercoat onto the glass substrate. In this example the image had 100% adhesion at 100, 90, 80, 70, 60, 50, 40, 30, 20 and 10% tints.

Example #10

In this example the thermal transfer ribbon of Example 5 was used. The heat activatable overprint ribbon of Example 5 was also used with the exception that the heat activatable layer was prepared as above except the Polywax 500 was used at 4.25 grams, the Ceramer 67 was used at 5.35 grams, the Elvax 40 was used at 5.25 grams, and a zinc steryl phosphate particle, LBT-1830 (Sakai Chemical, 5-1 Ebysujima-cho, Sakai-City, Osaka, Japan) was stirred in at 0.25 grams.

In this example the ceramic ink decal and lamination process of Example 5 was used to transfer the heat activatable overprint, ceramic ink image and undercoat onto the glass substrate. In this example the image had 100% adhesion at 100, 90, 80, 70, 60, 50, 40, 30, 20 and 10% tints.

Example #11

In this example, the overprint was prepared as in Example 10, except the heat activatable layer had 0.25 grams a silica particle Finesil (Tokuyama Corp., 1-1 Mikage-cho, Tokuyama, Yamaguchi, 745, Japan) stirred in the ink before coating onto the thermal transfer ribbon in place of the zinc steryl phosphate particles.

In this example the ceramic ink decal and lamination process of Example 5 was used to transfer the heat activatable overprint, ceramic ink image and undercoat onto the glass substrate. In this example the image had 100% adhesion at 100, 90, 80, 70, 60, 50, 40, 30, 20 and 10% tints.

Example #12

The heat activatable overprint ink was prepared in the same fashion as in Example 8 except the heat activatable layer was prepared with the Polywax 500 being omitted, the Elvax 40 was omitted and the Ceramer 67 was used at 14.97 grams.

In this example the ceramic colorant thermal transfer ribbon of Example 5 and the heat activatable thermal transfer ribbon of this example were used to print the thermally transferable ceramic decal as described in Example 5. The ceramic ink decal and lamination process of Example 5 was then used to transfer the heat activatable overprint, ceramic ink image and undercoat onto the glass substrate.

In this example the image had 100% adhesion at 100, 90, 80, 70, 60, 50, 40, 30, 20 and 10% tints.

Example #13

The heat activatable overprint ink was prepared in the same fashion as in Example 8 except the Polywax 500 was used at 4.1 grams, the Ceramer 67 was used at 5.12 grams, the Evaflex 577 was used at 5.12 grams and the Finesil was used at 0.63 grams.

In this example the ceramic colorant thermal transfer ribbon of Example 5 and the heat activatable thermal transfer ribbon of this example were used to print the thermally transferable ceramic decal as described in Example 5. The ceramic ink decal and lamination process of Example 5 was then used to transfer the heat activatable overprint, ceramic ink image and undercoat onto the glass substrate. In this example the image had 100% adhesion at 100, 90, 80, 70, 60, 50, 40, 30, 20 and 10% tints.

Example #14

The process described in Example 5 was followed with the following exceptions: A ceramic ink was prepared by mixing 21.45 grams of hot toluene with 5.94 grams of the methacrylate Dianal BR113 (Dianal America, Pasadena, Tex.), 1.46 grams of the ethylene vinyl acetate Elvax 250 (Dupont, Wilmington, Del.), and 0.45 grams of the polyamide gellant, Uniclear 100 (Arizona Chemical). These components were allowed to dissolve completely and then cooled to ambient temperature. Subsequently, 0.79 grams of the polyacrylate dispersant Disperbyk 2001 (Byk-Chemie, Wallingford, Conn.), 3.14 gram of dioctyl phthalate (Chemcentral, Chicago, Ill.), 32.54 grams of the flux 20-8380 (Ferro Corp, Washington, Pa.), 5.97 grams of the Zircon Opacifier Superpax Plus (Cookson-Matthey, Jacksonville, Fla.), 5.39 grams of the 94C1001 Flux (Johnson & Matthey, 498 Acorn Lane, Dowington, Pa.) and 0.98 grams of the Cerdec Black oxide 1795 (Cerdec/Ferro, Washington, Pa.) were added to the mixture. To the mixture was added 50 grams of ceramic milling media (0.3 mm). The mixture was milled on a Red Devil paint shaker until a 7 hegman grind (particle size of 0-5 microns) was achieved. Then 21.92 grams of the 15% dispersion of alcohol modified paraffin wax Unilin 425 (Baker Petrolite, Sugarland, Tex.) in methyl ethyl ketone was added. The mixture was re-milled until a 7 Hegman grind was achieved. The ceramic media was filtered out using a 400 micron nylon filter bag.

This ceramic ink was then coated via a meyer rod to achieve a dry coating weight of 6.5 grams per square meter onto the release coating side of the polyester film to prepare the ceramic ink thermal transfer ribbon.

In this example the ceramic colorant thermal transfer ribbon of this example and the heat activatable thermal transfer ribbon of this example of Example 5 were used to print the thermally transferable ceramic decal as described in Example 5. The ceramic ink decal and lamination process of Example 5 was then used to transfer the heat activatable overprint, ceramic ink image and undercoat onto the glass substrate. In this example the image had 100% adhesion in all 10 of the tint strength boxes.

Example #15

In the ceramic ink of Example 4 a rheology modifier was incorporated into the ink composition to reduce the amount and rate of settling of the frits and opacifiers out of the mixture.

In this example the same ceramic ink was prepared as in Example 4 except the 0.45 grams of polyamide gellant rheology modifier (Uniclear 100 from Arizona Chemical) was not added to the formula.

Samples of the ceramic inks from both this Example 15 and Example 4 were subjected to a settling test. The settling rates were evaluated via a modified ASTM #D869-85. Cylindrical glass containers measuring 5"H×1"D were filled to 4" high with ink and allowed to remain undisturbed for 48 hours. Observations were taken at 4, 8, 16, 24, and 48 hours for evidence of frit separation and settling.

In example #15 the frit in the ceramic ink not containing rheology modifier had settled into a distinct bottom layer after 4 hours. After 24 hours this frit layer was hard and very difficult to re-disperse with a spatula.

In the frit ink from Example 4, containing rheology modifier, the ceramic ink had some slight stratification of the frit towards the bottom after 48 hours. However, this ink was easily re-dispersed with a spatula.

In this example decals were prepared with the ceramic inks of Examples 4 and 15. In accordance with the procedures described in Example 5, images were transferred to glass substrates. The glass substrate/decal assembly was tempered at 1250° F. for 3 minutes and then quenched with room temperature air. It was found that the rheology modifiers containing ink had no adverse effect on pinholes, cracking, or opacity of the fired image as compare to the sample not containing rheology modifiers.

Example #16

The process as described in Example 5 for creating a ceramic colorant decal was followed with the following exceptions:

An undercoat ink was prepared by dissolving 15 grams of the silicone wax SF-8W (Cross Chemical Co., Inc., 134 Woodmere, P.O. Box 09758, Detroit, Mich. 48209) into 85 grams of warm toluene. This undercoat ink was then coated via meyer rod onto the face side of a back-coated polyester film at a dry coatweight was 0.4 grams per square meter. This undercoat was then topcoated with a ceramic ink as described in Example 5.

The process of printing a ceramic decal was followed as in Example 5 with the exception that the print energy was reduced to a level of 16 on the Matan Spark thermal transfer printer. Print quality of the decal was found to be excellent consistent with that produced in Example 5.

It is therefore, apparent that there has been provided, in accordance with the present invention, a method and apparatus for transferring a digital image to a glass or ceramic substrate with a decal assembly. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

Example #17

In this example a heat activatable overprint ribbon and ceramic ink thermal transfer ribbon were prepared as described in Example 4. The process used in Example 5 was followed except the heat activatable overprint ribbon was printed directly onto a releasable, covercoated paper substrate using a Matan Spark printer at an energy level of 28-32 and a print speed of 0.5 inches per second to form a heat activatable decal. An imaged ceramic decal was then prepared by printing with the Matan Spark printer a set of 10 rectangular boxes measuring 30 mm by 60 mm with 5 mm clear spaces in between each box with the ceramic ink thermal transfer ribbon onto a covercoated transfer sheet with.

The heat activatable overprint decal was then affixed to the glass substrate using the hot lamination process described in Example 5, the laminate was allowed to cool to a below 120 degrees F. and then the flexible decal substrate was slowly peeled away by hand from the covercoat, heat activatable layer and glass substrate, forming a heat activatable glass assembly.

Then the imaged ceramic decal was then placed on the covercoat side of the heat activatable glass assembly and the ceramic image was transferred to the assembly using the same process described in Example 5. The ceramic decal/heat activatable glass assembly was then allowed to cool to below 120° F. and the flexible substrate was gently peeled off by hand leaving. Less than 15% of the ceramic image was transferred from the ceramic decal to the glass substrate. The covercoat which transferred to the glass substrate along with the heat activatable layer may have interfered with the transfer of the ceramic image from the ceramic decal to the glass substrate.

Example #18

The process of Example 17 was followed except the heat activatable overprint ribbon was printed directly onto the flexible decal substrate described in Example 1 to form a heat activatable transfer assembly. This heat activatable transfer assembly was then heat laminated to a glass substrate The assembly was then allowed to cool to below 120° F. and the flexible decal substrate was gently peeled off by hand leaving just the heat activatable layer on the glass substrate.

Then a ceramic decal described in Example 17 was then placed on top of the heat activatable glass assembly and laminated according to the process described above. The glass substrate/ceramic decal assembly was then allowed to cool to below 120° F. and the flexible decal substrate was gently peeled off by hand leaving the covercoat, ceramic image and heat activatable layer directly on the glass substrate. 100% of the ceramic image transferred to the glass substrate.

We claim:

1. A decal assembly comprising a. a decal support, b. a releasable imaged covercoat disposed on said decal support, and c. an section comprised of I. an ink layer comprised of an ink selected from the group consisting of a ceramic ink, a frit ink, and combinations thereof, II. said ink layer forms a digital image and III. a heat activatable layer that has a first adhesion to a glass substrate at a first temperature and a second adhesion to said glass substrate after being heated to a second temperature, wherein said first temperature is lower than said second temperature and said first adhesion is lower than said second adhesion, wherein the releasable imaged covercoat has an elongation to break of at least about 1 percent, and wherein said imaged covercoat can be separated from the decal support with a peel force of less than about 30 grams per centimeter.

2. The decal assembly as recited in claim 1, wherein said heat activatable layer has said first adhesion to said glass substrate at a first temperature, such that, when said first heat activatable layer is placed on said glass substrate with a pressure of at least about 1 pound per square inch at a temperature of from about 10 degrees Celsius to about 30 degrees Celsius, said heat activatable layer weakly adheres to said glass substrate such that a peel force of 1 gram per centimeter removes said heat activatable layer from said glass substrate.

3. The decal assembly as recited in claim 2, wherein said heat activatable layer has said second adhesion to said glass substrate after being heated to said second temperature such that, when said heat activatable layer is placed on said glass substrate with a pressure of at least about 50 pounds per square inch at a temperature of from about 35 degrees Celsius to about 100 degrees Celsius, said heat activatable layer adheres to said glass substrate such that a peel force of 2 grams per centimeter fails to remove said first heat activatable layer from said glass substrate.

4. The decal assembly as recited in claim 3, wherein said heat activatable layer has a greater adhesion to said digital image than said releasable covercoat has to said decal support, such that, after said heat activatable layer adheres to said glass substrate, said decal support may be peeled away from said releasable covercoat and at least about 90 percent of said digital image remains on said heat activatable layer and less than about 10 percent remains on said decal support.

5. The decal assembly as recited in claim 3, wherein said heat activatable layer is comprised of at least about 75 weight percent of a solid, carbonaceous binder.

6. The decal assembly as recited in claim 5, wherein said heat activatable layer is present at a coating weight of from about 0.1 to about 10.0 grams per square meter.

7. The decal assembly as recited in claim 6, wherein said solid, carbonaceous binder has a softening point of from about 35° C. to about 150° C.

8. The decal assembly as recited in claim 7, wherein said solid, carbonaceous binder is selected from the group consisting of polyethylene-co-vinylacetate, polyethylene, polypropylene, wax, copolymers comprised of alpha olefin and maleic anhydride, polyvinylbutyral, polyvinylacetates, polyvinylacetal, ethylcellulose, phenoxy resin, polyurethane, epoxies, polyester, polyacrylate, ethoxylated alcohol polyolefins and mixtures thereof.

9. The decal assembly as recited in claim 7, wherein said solid, carbonaceous binder is comprised of a first synthetic resin and a second synthetic resin.

10. The decal assembly as recited in claim 9, wherein said solid, carbonaceous binder is comprised of from about 10 to about 60 weight percent of said first synthetic resin and from about 10 to about 60 weight percent of said second synthetic resin.

11. The decal assembly as recited in claim 10, wherein said first synthetic resin is a polyethylene and said second synthetic resin is a polyethylene-co-vinylacetate.

12. The decal assembly as recited in claim 7 wherein said solid carbonaceous binder is comprised of a copolymer of alpha olefin and maleic anhydride.

13. The decal assembly as recited in claim 12 wherein said solid carbonaceous binder is further comprised of polyethylene and polyethylene copolymers.

14. The decal assembly as recited in claim 7, wherein said solid, carbonaceous binder is further comprised of a wax present at a concentration of from about 0.1 to about 75 weight percent.

15. The decal assembly as recited in claim 14, wherein said wax is present at a concentration of from about 5 to about 40 weight percent.

16. The decal assembly as recited in claim 15, wherein said wax is present at a concentration of from about 10 to about 30 weight percent.

17. The decal assembly as recited in claim 14, wherein said wax is selected from the group consisting of a carnuaba wax, a rice wax, a beeswax, a candelilla wax, a montan wax, a paraffin wax, a microcrystalline waxes, an oxidized wax, an ester wax, a low molecular weight polyethylene wax, olifinic wax, a Fischer-Tropsch wax, long chain carboxylic acids, fatty acids and combinations thereof.

18. The decal assembly as recited in claim 14, wherein said wax is an alpha olefinic wax.

19. The decal assembly as recited in claim 2, wherein said ink layer is present at a coating weight of from about 2 to about 15 grams per square meter.

20. The decal assembly as recited in claim 19, wherein said ink layer further comprises from about 15 to about 94.5 weight percent solid, carbonaceous binder.

21. The decal assembly as recited in claim 20, wherein said ink layer further comprises at least one ink material selected from the group consisting of a film-forming glass frit, an opacifier, a colorant, and combinations thereof.

22. The decal assembly as recited in claim 21, wherein said ink material is comprised of said film-forming glass frit present at a concentration of from about 0.1 to about 75 weight percent.

23. The decal assembly as recited in claim 22, wherein said ink material is comprised of said colorant present at a concentration from about 0.1 to about 75 weight percent and wherein said colorant has a melting point at least about 50° C. greater than said film-forming glass frit.

24. The decal assembly as recited in claim 21, wherein said ink material is comprised of said opacifer present at a concentration of from about 0.1 to about 75 weight percent.

* * * * *